US007823358B2

(12) United States Patent
McStay

(10) Patent No.: US 7,823,358 B2
(45) Date of Patent: Nov. 2, 2010

(54) RELATIONALLY PREDIMENSIONED STONE SURFACING SYSTEM

(75) Inventor: Robert D. McStay, Buffalo, WY (US)

(73) Assignee: BuffaloStone, Inc., Buffalo, WY (US)

( * ) Notice: Subject to any disclaimer, the term of this patent is extended or adjusted under 35 U.S.C. 154(b) by 1341 days.

(21) Appl. No.: 10/134,227

(22) Filed: Apr. 25, 2002

(65) Prior Publication Data

US 2003/0200713 A1 Oct. 30, 2003

(51) Int. Cl.
*E04F 15/08* (2006.01)

(52) U.S. Cl. ..... 52/575; 52/574; 52/311.2; 52/311.1; 404/34; 405/284

(58) Field of Classification Search ..... 52/311.2, 52/314, 311.1, 313, 575, 574, 747.11; 428/33; 404/41, 42, 34; 446/115, 124, 125, 69; 405/284
See application file for complete search history.

(56) References Cited

U.S. PATENT DOCUMENTS

| | | | | | |
|---|---|---|---|---|---|
| 13,785 | A | * | 11/1855 | McClintock | 209/691 |
| 394,048 | A | * | 12/1888 | Anderson | 52/415 |
| 511,497 | A | * | 12/1893 | Blaine | 404/41 |
| 533,807 | A | * | 2/1895 | Hettich | 52/747.11 |
| 726,506 | A | * | 4/1903 | Capen | 52/591.4 |
| 860,012 | A | * | 7/1907 | Christian | 52/569 |
| 1,513,184 | A | * | 10/1924 | Reagan | 404/34 |
| 1,622,103 | A | * | 3/1927 | Fulton | 52/390 |
| 2,039,097 | A | * | 4/1936 | Malm | 211/1 |
| 2,136,346 | A | * | 11/1938 | Wadman | 52/604 |
| 3,041,785 | A | * | 7/1962 | MacDonald et al. | 52/309.3 |
| 3,922,105 | A | * | 11/1975 | Bolli | 404/34 |
| 4,666,162 | A | * | 5/1987 | Campbell | 272/249 |
| 5,281,047 | A | * | 1/1994 | Skaug | 404/42 |
| 5,673,529 | A | | 10/1997 | Treister et al. | 52/511 |
| 5,782,667 | A | * | 7/1998 | Luby | 446/69 |
| 5,791,100 | A | | 8/1998 | Schieferly et al. | 52/177 |
| 6,119,423 | A | * | 9/2000 | Costantino | 52/390 |
| 6,286,287 | B1 | * | 9/2001 | Dieter | 52/731.2 |

FOREIGN PATENT DOCUMENTS

| | | | | |
|---|---|---|---|---|
| GB | 2048979 | * | 12/1980 | 52/311.2 |
| JP | 178650 | * | 7/1989 | 52/311.2 |
| JP | 264584 | * | 9/1994 | 52/311.2 |

OTHER PUBLICATIONS

Freeman and Company New York, Feb. 1, 1987, Branko Grunbaum, pp. 1 and 501.*
Stone Classification Information, IMG Publication, Apr. 8, 2002, 2 pages.

* cited by examiner

*Primary Examiner*—Phi D. A
(74) *Attorney, Agent, or Firm*—Santangelo Law Office P.C.

(57) ABSTRACT

A surfacing system including both methods and apparatus may in some embodiments comprise a single width relationally sized surfacing system and associated design patterns that involve discrete stone surface units in several embodiments. In at least one embodiment, surfacing units are stone. A multi-width surfacing unit system is also included as part of the invention, as are associated design patterns. Other embodiments include surface unit packaging apparatus and methods that reduce surface unit transport costs and breakage.

20 Claims, 20 Drawing Sheets

Pattern #1

Pattern #1

Pattern #2

Pattern #3

Pattern #3

Pattern #3

Pattern #4

Pattern #5

Pattern #6

Pattern PL1166

Pattern PL66

Pattern PL11

Pattern PL11D

Pattern PL22

Pattern PL2266

Pattern PL66D

Pattern #14

RELATIONALLY PREDIMENSIONED STONE SURFACING SYSTEM

The present invention relates to systems, including apparatus and methods, for relationally sizing surfacing units, for using those units to create various surface pattern designs, and for packaging the surfacing units so as to minimize breakage during transport and transportation costs. The invention further relates to surfacing systems that minimize post-installation surfacing material waste or "left-over". It also relates to predimensioning surfacing materials so that dimensions follow precise mathematical relationships, resulting in optimization of the surfacing unit packaging and transportation processes, and the surfacing unit installation and surface construction processes.

I. BACKGROUND

Surfacing, whether it be of roads, walkways, building walls, kitchen floors, or desktops (as but a few examples), is a multi-billion dollar industry in the United States alone and includes technologies that have been highly developed over many years. Generally, the term surfacing relates to installation, application or construction of a surface (generally a portion of a solid stratum (or simply a solid, and including materials such as dirt, grass, gravel, rock, wood or concrete, to name a few) that interfaces with a fluid medium such as air) proximately to or in place of an underlying or pre-existing surface so as to improve or enhance durability, appearance, wear, or any number of material indices of the solid at the solid/fluid interface. The present invention relates generally to what may be termed discrete unit (or simply discrete) surfacing (meaning comprised of a plurality of discrete units, as opposed to what may be termed continuous or non-discrete surfacing such as bituminous road paving) that may be generally found in or around buildings and/or forming walkways or patios (as but a few examples) and is generally used for aesthetic and functional reasons.

For centuries, the repetitive nature and the resultant patterns that may arise from the use of a plurality of discrete individual surface (or surfacing) units (often in addition to what may be termed grout lines that exist between the installed discrete units) has improved the aesthetics of rooms, foyers, lobbies, patios, bathrooms, and kitchens, as but a few examples. Further, the look of the surface of the presupplied discrete units themselves (e.g., the appearance of a polished marble that may have veins and lines of separation) lends an appeasing natural look to any surface and enhances the overall appearance (perhaps as well as the commercial value) of any property on which it exists. Functionally, using discrete thin surface units that are often small in comparison to the surface they are used to cover allows for economic surfacing due to a minimization of predimensioned (e.g., off-job-site) surfacing material waste during on-job-site customization of edge units. Further functional economy is realized when repair of a damaged installed discrete surfacing unit surface may only require repair of one unit. Use of discrete surfacing units may also facilitate installation in that only the necessary number of discrete surfacing units need be transported to the job-site (in addition to the required substrate or grout). Further, the units may be transported to the job site in easily manageable crates, boxes or containers.

Despite the many advantages of the general discrete surfacing unit surfacing system, there has been a desire for many years to improve the installation and transportation processes, as well as the appearance and functionality of the resulting surface itself. Installation, although often performed at high efficiency, sometimes resulted in an unacceptably high amount of left-over or wasted surfacing material for a given job site—material whose unique type and quality often precludes investment recovery through use on another surfacing job. The appearance and aesthetics afforded by the ubiquitous square dimensioned thin surface units and the limited patterns they allow has been considered by some to have plateaued, although still aesthetic. Breakage during transport of expensive thin surface unit slabs and of discrete thin surface units shipped or delivered from quarries (or that are transported from any location and are made from stone) has always been a problem in the industry, as has also been the exorbitantly high costs of shipment.

II. SUMMARY OF THE INVENTION

The present invention includes a variety of aspects that may be selected in different combinations based upon the particular application or needs to be addressed. In one basic form of the invention, a relationally sized thin surface unit surfacing system (also referred to as a relational sizing surfacing (or surface) system) discloses the use of a plurality of each of at least three differently lengthed but substantially equally wide relationally sized predimensioned surface (or surfacing) units for constructing a surface. The dimensions of the relationally sized thin surface units may be mathematically related and there may be equal numbers of each of the differently lengthed thin surface units of the system. Two general embodiments of the relationally sized thin surface unit surfacing system may be the non-uniform grout width surfacing system and the uniform grout width surfacing system (note that grout width is a general term used to define the distance between all or certain of the installed thin surface units; this distance may be "filled" with a substrate or grout or other material that may harden upon drying after initial installation.)

In one non-uniform grout width embodiment, each of the different lengths may be related to one another and each of the lengths itself may be related to a unit width and what may be termed a longitudinally adjacent thin surface unit design separation width (which may also be referred to as a longitudinally adjacent thin surface unit design grout width). The longitudinally adjacent thin surface unit design grout width may be that design grout width between longitudinally adjacent thin surface units in certain of several designs (particularly those designs wherein thin surface units abut one another perpendicularly and at ends so as to form a "L" shape). In one uniform grout width embodiment, each of the three or more lengths may be mathematically related to a uniform thin surface unit design separation width and a unit width. Note that the term building is meant to describe anything that is built or constructed, and thus may include isolated walkways or patios, and is not limited to residences or structures conventionally termed "buildings".

The main objectives of each of the two general embodiments of the relationally sized thin surface unit surfacing system are increased facility of creation of certain patterned surfacing designs, increased accuracy in calculation of amounts of thin surface units necessary to complete a specific surfacing job, and enablement of savings in the transportation process.

Another broad goal of an embodiment of the invention is to provide a multi-width thin surface unit surfacing system that may be used to create thin surface units with unique patterns and that may allow for a highly efficient and accurate thin surface unit predimensioning and installation system. There may be three or more different widths that each may be mathematically related to one another, and each width may come in different lengths (none, one, more than one, or all the widths may come in different lengths). Within each width unit, there may be an equal number of differently lengthed surfacing units. Also, the number of thin surface units of a certain width may be related to the number of thin surface units of each of the remaining widths, regardless of whether any of the widths come in different lengths. For example, in the case where there are three widths, twenty percent of all the thin surface units may have the largest width, forty percent may have the second largest width, and forty percent may have the smallest width.

Certain mathematical relationships between the widths, such as, for example, in the case where there are three widths (although these relationships may also hold in cases where there are more than three widths), the largest width less approximately one-eighth inch may be approximately equal to three times the smallest width and approximately equal to one and one-half times the intermediate width. Such a relationship (and other different relationships) may improve the overall surfacing process in that the largest width, as it may be the width of the thin surface units as they are shipped, can be cut once to form the remaining two widths. Upon receiving an order for the multi-width system, the smaller widths (i.e., smaller than the largest width) may be created from the units and, upon determination of the exact size of a job's surface, and perhaps factoring in a waste allowance, an accurate required number of thin surface units of each width and each length within each width can be calculated, minimizing post-installation surface material waste and minimizing transportation costs to a job-site. Another broad objective of the multi-width system is simply to provide a system for creating an aesthetic, multi-width thin surface unit surfacing system and surface pattern.

Another broad goal of the invention is to minimize transportation costs by more efficiently packing or containing discrete surfacing units and by minimizing surfacing unit breakage during transport through use of an innovative packaging system. This packaging system may be for a set of discrete surfacing units that may be of two or more lengths and one or more width. A preferred embodiment is for packaging for four lengths and one width, but, again, packaging for more than one length, but one width, or more than one length and more than one width, is considered an aspect of the invention. A number of each of the different lengths of crated thin surface units may be equal. Of course, other embodiments where the number of each length of crated surfacing unit is not equal are considered part of the invention. Savings in transport or shipping costs may be achieved due to the innovative packaging technology that may involve a plurality of layers stacked one atop another (perhaps separated by padding), wherein each layer may contain thin surface units that are horizontally edge stacked (or just contain all maximum length crated thin surface units) so that they total (in length) an integer multiple of the maximum crated surfacing unit length.

It is possible, however, that one or more of the layers may contain horizontally edge stacked thin surface units that have a total far left edge to far right edge length that is less than an integer multiple of the maximum crated thin surface unit length. Such systematic packaging achieves savings through efficient use of crate space. Innovative padding systems that are incorporated in this packaging system as described in detail below, in addition to innovative placement of the more easily breakable maximum length thin surface units can effect a reduction in the surface material breakage amounts incurred during transport. Note that the term crate (or crated) is not intended to be any less broad than the term container (or contained). The term crate is used instead of the term container to differentiate from that element that is referred to as a container—the larger shipping container in which crates may be held during transport. Note that the use of the term "equals" above, as throughout the entire application, including the claims, implies substantially or approximately equal, whether or not the term substantially or approximately is used. Further where the term "equal" may not appear and instead the application (specification and claims, including figures and references) simply states that a distance or measurement "is" or "may be" a certain value, that distance is approximately or substantially equal to the value, regardless of the absence of the words substantially or approximately.

Another broad goal of the invention is to provide several aesthetic patterns according to which a surface can be set. Each of the patterns may be created from the most basic relational sizing surface systems (both the uniform grout width and the non-uniform grout width) in which several of the dimensions are mathematically related (hence the term relational). Also, several of the patterns may require approximately equal numbers of each of several different lengths of thin surface units and thus may accord well with those relational sizing surfacing systems in which there are relatively equal numbers of each of several different lengths of thin surface units. Efficiency in the entire surfacing process, from ordering to installation, can be achieved as the patterns may be used in conjunction with many of the relational sizing surface systems. Also, an aesthetic appearance of the patterned surface can be achieved.

Naturally, further objects of the invention are disclosed throughout other areas of the specification and drawings. Note that all drawings that follow, in addition to the Examples, are depictions of a possible embodiment and are not necessarily requirements.

III. BRIEF DESCRIPTION OF THE DRAWINGS

IV. DETAILED DESCRIPTION OF THE PREFERRED EMBODIMENTS

In a general sense, a basic embodiment referred to as the non-uniform grout width relational sizing surfacing system may include at least two of each of three differently lengthed thin surface units having equal widths. The lengths and widths may be sized such that, upon installation in accordance with a design that, for aesthetic reasons, maximizes the length of equal grout width, each length follows a certain mathematical relationship with a longitudinally adjacent thin surface unit separation width (longitudinally adjacent grout width) and the unit width (expressed below). The system may include thin surface units having "n" lengths (where "n" may be an integer greater than three, e.g. strictly four lengths). The number of each of the three lengths of the thin surface units in the basic embodiment expressed above may be substantially equal to one-third of the total number of surfacing units, whether, e.g., as ordered, predimensioned, delivered, packaged or installed.

Figure 20:
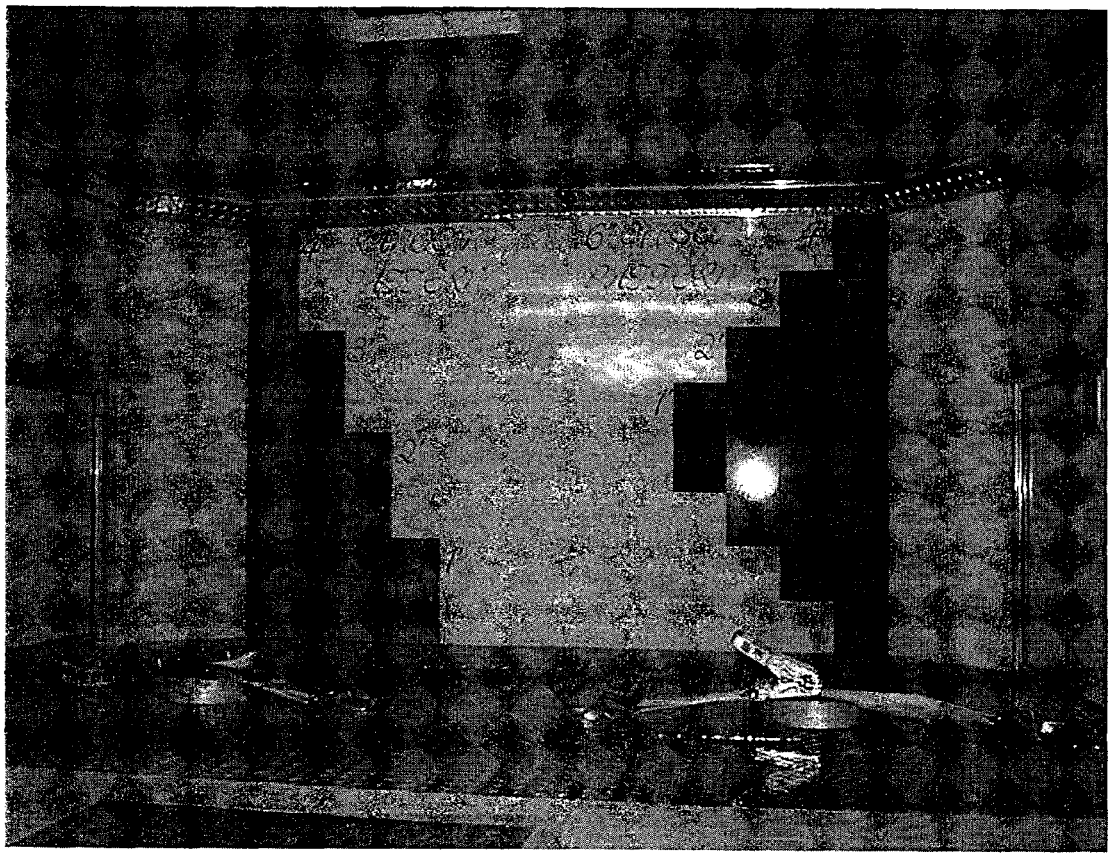
FIG. 20 shows stone surface units having four different lengths.
Figure 21:
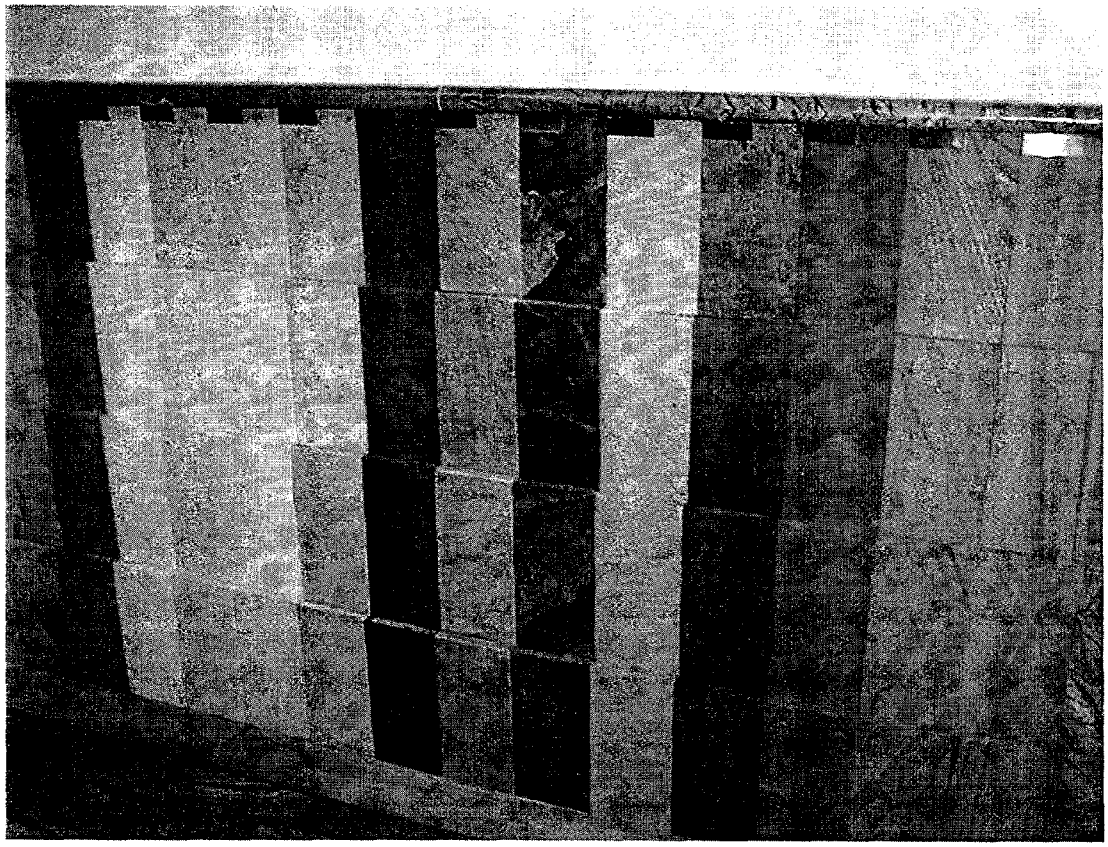
FIG. 21 shows stone surface units having four different lengths.

In a system having four different lengths (four differently lengthed surface units may be as shown in FIGS. 20 and 21), the number of each of the four lengths of the thin surface units may be substantially equal to one-fourth of the total number of surfacing units, whether, e.g., as ordered, predimensioned, delivered, packaged or installed. In the above-mentioned system having n different lengths, the number of each of the n lengths of the thin surface units may be substantially equal to one-$n^{th}$ of the total number of surfacing units, whether, e.g., as ordered, predimensioned, delivered, packaged or installed. In any of the above systems, the first length may be approximately (or substantially) equal to twelve inches, the second length may be approximately equal to twenty-four inches, the third length may be approximately equal to thirty-six inches, the fourth length may be approximately equal to forty-eight inches, and/or the $n^{th}$ length may be approximately equal to n times twelve inches. A unit width, when expressed may be approximately equal to five and seven-eights inches. A longitudinally adjacent thin surface unit separation width (or longitudinally adjacent grout width) may be one-eighth inch, but in any case is non-negligible. So too, the uniform thin surface unit separation width (or uniform grout width) is non-negligible. As such, any technology involving surfacing elements that, upon installation, do not have a non-negligible width between them (i.e., have no discernible width between them) may be considered inherently different technology from one perspective.

The above dimensions (or specifications) are but one example of the possible dimensions of the surface units. They may be listed in the Examples that form a part of this specification and which are each hereby incorporated by reference. Any recitation of precise specifications, whether in this textual portion of the specification or in the incorporated Examples is intended as an example only and is not to be read to preclude the possibility that the claims or the design in general exhibit other lengths, widths, heights, thicknesses, or distances in general. So too, the use of "stone thin surface units", "quarried material thin surface units", or any other use in the specification of "surface unit" with a qualifier is intended as an example of a possible embodiment and is not intended to preclude the possibility that an embodiment that incorporates or comprises surface units with no qualifier or a different qualifier exists. Further, the term system as used herein may be used to refer to either an apparatus or method.

Note that any claims that limit surfacing units and installed surfaces to stone surfacing units (as well as installed stone surface) are intended to encompass not only natural stone surfacing units, but also surfacing units that are made from materials that give the appearance that the finished product is made from stone. Such stone-like materials may be termed man-made stone or artificial stone (as but a few examples) and may be ceramic, plastic, porcelain, clay or other non-natural stone material (as but a few examples). Natural stone may include, but is not limited to, granite, limestone, marble, sandstone and slate. The term quarried material refers to material taken from, mined or harvested from a stone or other quarry or mine, or any naturally occurring reserve of a certain material. Even where not so qualified, thin surface units are not intended as made of wood or metal in most embodiments.

In a basic system, which may be generally termed a non-uniform thin surface unit design separation width (otherwise known as a non-uniform grout width) relationally sized thin surface unit surfacing (or surface) system (including apparatus and methods), a relational surface system may comprise a plurality of predimensioned rectangular first length thin surface units substantially having a unit width and substantially having a first length, a plurality of predimensioned rectangular second length thin surface units substantially having this unit width and substantially having a second length, and a plurality of predimensioned rectangular third length thin surface units substantially having this unit width and substantially having a third length, wherein a total of the unit width plus a longitudinally adjacent thin surface unit design separation width may be substantially equal to one-half the first length, a total of the unit width plus the longitudinally adjacent thin surface unit design separation width may be substantially equal to one-fourth the second length, and a total of the unit width plus the longitudinally adjacent thin surface unit design separation width may be substantially equal to the one sixth the third length. As used herein, the term unit width simply refers to the width of a given surface (or surfacing) unit. The relation among the unit width, the longitudinally adjacent thin surface unit design separation width and each of the lengths may be equally expressed by the following equations:

Non-Uniform Grout Width Equations:

$$W_u+W_{lad}=L_1/2=L_2/4=L_3/6$$

Where:

$W_u$=thin surface unit width $W_{lad}$=longitudinally adjacent thin surface unit design separation width $L_1$=first length $L_2$=second length $L_3$=third length The term predimensioning generally refers to a shaping or cutting (or generally dimensioning) of a piece of surfacing off-jobsite (e.g., at a factory, quarry or shop instead of at the job-site (where custom cutting or custom dimensioning may be necessary to dimension certain thin surface units so they meet specific sizing requirements unique to a given surfacing job)). The term predimensioned refers in a similar manner to cut or shaped (or dimensioned) off-jobsite. Predimensioning (as well as predimensioned) may be used to also refer generally to generating off-jobsite an entire lot of "shaped-as-ordered" thin surface units. Note that some thin surface units may be cut on-jobsite (such as, perhaps, the diagonal cut thin surface units of pattern four described below, for example). The term non-uniform thin surface unit design separation (see FIG. 1) width is a more general term for what may more commonly be termed a nonuniform grout width and is associated with a surface system that is to be distinguished from the surface system associated with what may be termed a uniform thin surface unit design separation width (which may be more commonly known as a uniform grout width). A rectangular thin surface unit generally refers to what, in more proper and precise geometric terms, is a rectangular solid thin surface unit (because the thickness is non-negligible). Although the thickness of the units is non-negligible (meaning it is other than zero or very near zero), the surface units are thin, as traditionally defined to include fractional relative to the length. However, a more specific definition of thin may be less than or equal to four centimeters, such as (but not limited to) three centimeters, two centimeters, or one centimeter. Of course, as with all lengths or distances expressed in metric units, the English unit equivalent (for two centimeters, for example, the English equivalent may also be considered three-quarters inch) also serves to describe the distance.

Figure 1:
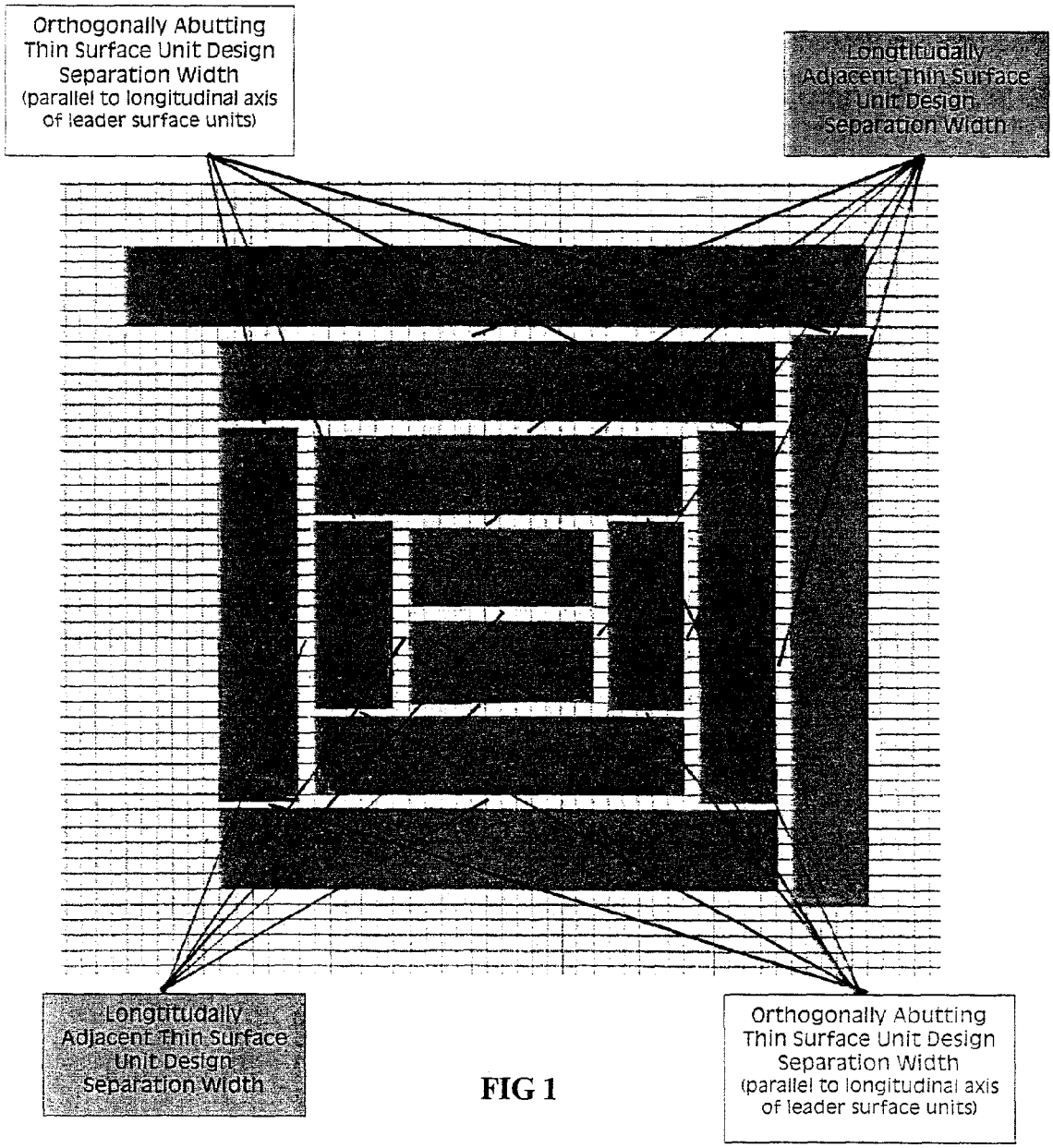
FIG. 1 shows the different design separation unit widths for the nonuniform grout width system for design pattern #1.

The term nonuniform refers to the fact that if the thin surface units sized in accordance with this specific system are installed according to a design or pattern that requires that some units be longitudinally aligned orthogonally to one another (or perpendicularly), then at least some of the longitudinally adjacent thin surface unit design separation widths may, in order to maximize the length of equal width grout line, be larger (by, e.g., one and one-half times) than at least some of the orthogonally abutting thin surface unit design separation widths (e.g., the ninety degree, end-to-end unit separation widths), as indicated in FIG. 1. In at least one design, specifically pattern one of figure two (again as shown in FIG. 1) only the orthogonally abutting thin surface unit design separation widths that are parallel to the longitudinal axis of the leader surface units (defined later) are different from the longitudinally adjacent thin surface unit design separation widths (see FIG. 1). The longitudinally adjacent thin surface unit design separation widths refers to the distance between edges of thin surface units that upon installation according to the design lie adjacent one another and whose longitudinal axes may be parallel, as indicated in FIG. 1. As used herein, two thin surface units (or their edges) may be said to abut even where their proximate edges (or the edges, if it is the edges that are said to abut) may be separated by a thin surface unit separation width (or a grout width); indeed, abutting, as used herein, may even require a lack of direct contact between the edges of the two abutting pieces (such as thin surface units).

Note that the term design is intended to differentiate from what may be termed the thin surface unit field separation width, which may be different from a thin surface unit design separation width for similarly sized thin surface units and a given design because the setters (persons who set the units) may stray from the thin surface unit design separation widths and create their own thin surface unit separation widths upon setting the units at a jobsite (whether through skillful manipulation of thin surface units or simple error (albeit error often noticeable only upon close inspection)). Thin surface unit design separation widths may be those unit separation widths (or, as known in the trade, grout widths) that, for a given design, tend to maximize the total length of equal thin surface unit separation width (or grout width). As illustrated for but one design as in FIG. 1, the thin surface unit design separation width (or design grout width) may be equal between longitudinally adjacent thin surface units and smaller (by, e.g., fifty percent) between units that abut one another perpendicularly (also termed orthogonally) at their ends. The potential variations in the thin surface unit field separation widths from the design separation widths necessitate the inclusion of the term design in the claims, thereby precluding avoidance of infringement liability by mere installation of thin surface units with varied separation widths. Only a design separation width is sufficiently definite to describe the particular surfacing system embodiment and enable comparison of different surfacing systems.

The above basic system may further comprise a plurality of predimensioned rectangular fourth length thin surface units substantially having the indicated unit width and substantially having a fourth length, wherein a total of the unit width plus the longitudinally adjacent thin surface unit design separation width may be substantially equal to one-eighth of the fourth length. The basic system may further comprise a plurality of predimensioned rectangular $n^{th}$ length thin surface units substantially having the unit width and substantially having a $n^{th}$ length, wherein a total of the unit width plus the longitudinally adjacent thin surface unit design separation width may be substantially equal to the $n^{th}$ length divided by a quantity two times n. "n" as used herein for embodiments of the nonuniform grout width surfacing system, refers (in this embodiment) to any integer greater than three. In any of the systems, the longitudinally adjacent thin surface unit design separation width may be approximately equal to one-eighth inch or one-fourth inch.

Non-Uniform Grout Width Equations (for Designs with Four Lengths or "n" Lengths):

$$W_u+W_{lad}=L_4/8=L_n/2n$$

Where:

$W_u$=thin surface unit width $W_{lad}$=longitudinally adjacent thin surface unit design separation width $L_4$=fourth length $L_n$=$n^{th}$ length If there are strictly three (i.e., not more, not less than three) different lengths of thin surface units in a system, a number of each predimensioned rectangular first length thin surface units, predimensioned rectangular second length thin surface units and installed rectangular third length thin surface units may be approximately one hundred divided by three percent the total number of predimensioned rectangular thin surface units, whether as shipped, purchased, delivered, packages or installed, as but a few examples. If there are strictly four different lengths of thin surface units, a number of each predimensioned rectangular first length thin surface units, predimensioned rectangular second length thin surface units, predimensioned rectangular third length thin surface units and predimensioned rectangular fourth length thin surface units may be approximately twenty-five percent the total number of predimensioned rectangular thin surface units, whether as shipped, purchased, delivered, packaged or installed, as but a few examples. If there are n lengths in a system, a number of each installed predimensioned rectangular first length thin surface units, installed predimensioned rectangular second length thin surface units and installed predimensioned rectangular $n^{th}$ length thin surface units may be approximately one-hundred divided by n percent the total number of installed predimensioned rectangular thin surface units, whether either as shipped, purchased, delivered, packaged or installed, as but a few examples.

In any system, the first length may be approximately equal to twelve inches, the unit width may be approximately five and seven-eighths inches, and/or the longitudinally adjacent thin surface unit design separation width may be one-eighth inch (or the indicated parameters may be any other sizes). In systems with n lengths, the $n^{th}$ length may approximately equal to n times the first length (or it may be any other value). Any of the above systems may further comprise square thin surface units. A surface such as, but not limited to, a floor, wall, counter, walkway, or patio made using a relational surface system of any of the above-mentioned embodiments is also contemplated as a part of the invention, as well as the entire building or job itself.

Methods corollary to the above-mentioned nonuniform thin surface unit design separation width apparatus are also considered embodiments of the invention. One such method is a method of surface creation and may comprise the steps of predimensioning a plurality of rectangular first length thin surface units to each have a unit width and a first length and so that a total of this unit width plus a longitudinally adjacent thin surface unit design separation width may be substantially equal to one-half of the first length; predimensioning a plurality of rectangular second length thin surface units to each have this unit width and a second length and so that a total of the unit width plus this longitudinally adjacent thin surface unit design separation width may be substantially equal to one-fourth of the second length; predimensioning a plurality of rectangular third length thin surface units to each have the unit width and a third length and so that a total of the unit width plus the longitudinally adjacent thin surface unit design separation width may be substantially equal to one-sixth the third length; and perhaps even fixedly establishing the thin surface units to create a surface.

This system may further comprise the step of predimensioning a plurality of rectangular $n^{th}$ length thin surface units to each have the unit width and a $n^{th}$ length and so that a total of the unit width plus the longitudinally adjacent thin surface unit design separation width may be substantially equal to the $n^{th}$ length divided by twice n (note that here, "n" may be equal to four or greater). A system involving strictly four different lengths of thin surface units may further comprise (relative to the three length method) the step of predimensioning a plurality of rectangular fourth length thin surface units to each have the unit width and a fourth length and so that a total of the unit width plus the longitudinally adjacent thin surface unit design separation width may be substantially equal to one-eighth of the fourth length.

In the three length system, the step of fixedly establishing the thin surface units to create a surface may comprise the step of fixedly establishing a first substantially one-third of the thin surface units using the plurality of rectangular first length thin surface units, the step of fixedly establishing a second substantially one-third of the thin surface units using the plurality of rectangular second length thin surface units and the step of fixedly establishing a third substantially one-third of the thin surface units using the plurality of rectangular third length thin surface units. The step of fixedly establishing the thin surface units to create a surface as in the system involving strictly four lengths may comprise the step of fixedly establishing a first substantially one-fourth of the thin surface units using the plurality of rectangular first length thin surface units, the step of fixedly establishing a second substantially one-fourth of the thin surface units using the plurality of rectangular second length thin surface units, the step of fixedly establishing a third substantially one-fourth of the thin surface units using the plurality of rectangular third length thin surface units and the step of fixedly establishing a fourth substantially one-fourth of the thin surface units using the plurality of rectangular fourth length thin surface units. The step of fixedly establishing the thin surface units to create a surface in the above-mentioned n-length system may comprise the step of fixedly establishing a first substantially one-$n^{th}$ of the thin surface units using the plurality of rectangular first length thin surface units, the step of fixedly establishing a second substantially one-$n^{th}$ of the thin surface units using the plurality of rectangular second length thin surface units, the step of fixedly establishing a third substantially one-$n^{th}$ of the thin surface units using the plurality of rectangular third length thin surface units, and so on, up to and including the step of fixedly establishing a $n^{th}$ substantially one-$n^{th}$ of the thin surface units using the plurality of rectangular $n^{th}$ length thin surface units. For purposes of clarity, one-$n^{th}$ would refer to one-sixth if n were six, for example. Any of the above-mentioned embodiments may also comprise the step of predimensioning a plurality of square thin surface units. A surface made using this "square thin surface unit method" or any of the other above-mentioned systems (or methods) is also considered an embodiment of the invention.

As a set of systems alternative to the above-mentioned nonuniform thin surface unit design separation width (otherwise known as a non-uniform grout width) relationally sized thin surface unit surfacing (or surface) system (including apparatus and methods), the uniform thin surface unit design separation width (otherwise known as a uniform grout width) relationally sized thin surface unit surfacing (or surface) system, includes embodiments whose thin surface units may be sized such that every thin surface unit design separation width is equal. The orthogonally abutting thin surface unit design separation widths (e.g., the ninety degree end-to-end unit separation widths) may be the same as the longitudinally adjacent thin surface unit design separation widths in the uniform thin surface unit design separation width relationally sized thin surface unit surface apparatus or system (and methods), while in the contrary nonuniform thin surface unit design separation width system, the two widths may be different (specifically, the orthogonally abutting thin surface unit design separation widths may be smaller than the longitudinally adjacent thin surface unit design separation widths). The uniform thin surface unit design separation width relationally sized thin surface unit surfacing system may include thin surface units that may be sized so that the setter need not manipulate or adjust the unit placements in contrivance to the design (i.e., the design that maximizes the uniform grout width length) in order to arrive at what at least appears to many persons to be a uniform grout width between all units. Instead, the setter need only follow the design (a design that, because of the sizing of the thin surface units includes uniform grout widths between all pieces (including orthogonal and parallel units)); no manipulation or adjustment by the setter from the design may be necessary to achieve what appears to be a surface whose units may be equally distant at all edges (again, such manipulation may be necessary to appease a discerning inspector of the nonuniform grout width surface system).

In a general sense, the uniform surface design separation width relationally sized thin surface unit surfacing system may include at least two of each of three differently lengthed thin surface units having substantially equal widths. The lengths and widths may be sized such that, upon installation according to a design each length follows a certain mathematical relationship with a uniform thin surface unit separation width and the unit width (expressed below). The system may comprise thin surface units having "n" lengths (where "n" may be an integer greater than three) or the system may be expressed as comprising thin surface units having strictly four lengths, for example. In systems having three lengths, the number of each of the three lengths of the thin surface units in the basic embodiment expressed above may be substantially equal to one-third of the total number of surfacing units, whether, e.g., as ordered, predimensioned, delivered, packaged or installed. In systems having four different lengths, the number of each of the four lengths of the thin surface units may be substantially equal to one-fourth of the total number of surfacing units, whether, e.g., as ordered, predimensioned, delivered, packaged or installed. In systems having n different lengths, the number of each of the n lengths of the thin surface units may be substantially equal to one-$n^{th}$ of the total number of surfacing units, whether, e.g., as ordered, predimensioned, delivered, packaged or installed. In any of the above systems, the first length may be—as but one example—approximately equal to eleven and seven-eighths inches, the second length may be approximately equal to twenty-three and seven-eights inches, the third length may be approximately equal to thirty-five and seven-eighths inches, the fourth length may be approximately equal to forty-seven and seven-eighths inches, and/or the $n^{th}$ length may be approximately equal to n times twelve inches less one-eighth inch. A unit width may be approximately equal to five and seven-eights inches. A uniform thin surface unit separation width may be one-eighth inch. Any recitation of precise specifications or distances is intended as an example and is not to be read to preclude the possibility that the claims or the design in general exhibit other lengths, widths, heights, thicknesses, or distances in general. Note that in this apparatus and all others described herein, dimensions expressed in English units are intended also to describe a length, width, height, thickness, etc, as the case may be, in equivalent metric units. The specification sheet included as the Examples express units in both metric and English units.

The uniform thin surface unit design separation width (otherwise known as a uniform grout width) relationally sized thin surface unit surfacing (or surface) system includes several variations on a basic system. The most basic system includes a plurality of predimensioned rectangular first length thin surface units having a unit width and a first length, wherein the first length may be substantially equal to a sum of a uniform thin surface unit design separation width plus a quantity twice the unit width; a plurality of predimensioned rectangular second length thin surface units having the unit width and a second length, wherein the second length may be substantially equal to a sum of three times the uniform thin surface unit design separation width plus a quantity four times the unit width; and a plurality of predimensioned rectangular third length thin surface units having the unit width and a third length, wherein the third length may be substantially equal to a sum of a five times the uniform thin surface unit design separation width, plus a quantity six times the unit width. For purposes of clarity, all equations expressed in written form herein are to be performed according to the following rules: the term "a quantity" indicates that the operations specified after the term "a quantity", but before the term "equal", are to be performed before the operation immediately preceding the term "a quantity" is to be performed. Otherwise (and within the "a quantity" clause), all operations are to be completed in left-to-right fashion (i.e., an operation is to be completed before the operation appearing next in writing is to be completed). At times, in a written formula, commas may be used to emphasize the proper left-to-right order of operation.

Uniform Grout Width Equations:

$$L_1=W_{ud}+2W_u$$

$$L_2=3W_{ud}+4W_u$$

$$L_3=5W_{ud}+6W_u$$

Where:

$W_u$=thin surface unit width $W_{ud}$=uniform thin surface unit design separation width $L_1$=first length $L_2$=second length $L_3$=third length $L_4$=fourth length $L_n$=$n^{th}$ length The basic system expressed above may further comprise a plurality of predimensioned rectangular $n^{th}$ length thin surface units having the unit width and a $n^{th}$ length, wherein the $n^{th}$ length may be substantially equal to a sum of two times n, less one, times the uniform thin surface unit design separation width, plus a quantity two times n times the unit width. The basic system may further comprise a plurality of predimensioned rectangular fourth length thin surface units having the unit width and a fourth length, wherein the fourth length may be substantially equal to a sum of a seven times the uniform thin surface unit design separation width plus a quantity eight times the unit width. Any of the above-mentioned uniform grout width apparatus may further include a plurality of predimensioned square thin surface units. A surface such as, but not limited to, a floor, wall, counter, walkway, or patio made using a relational surface system of any of the above-mentioned embodiments is also contemplated as part of the invention.

Uniform Grout Width Equations (for Four and "n" Length Systems):

$$L_4=7W_{ud}+8W_u$$

$$L_n=(2n-1)W_{ud}+2nW_u$$

Where:

$W_u$=thin surface unit width $W_{ud}$=uniform thin surface unit design separation width $L_4$=fourth length $L_n$=$n^{th}$ length In any of the above-mentioned uniform grout width systems, the first length may—in one example—be approximately equal to eleven and seven-eighths inches, the second length may be approximately equal to eleven and seven-eighths inches, the third length may be approximately equal to thirty five and seven-eights inches, and/or the fourth length may be approximately equal to forty-seven and seven-eighths inches. The unit width may be approximately equal to five and seven-eighths inches. The uniform grout width may be approximately equal to on-eighth inch or one-fourth inch.

A distinct manner of expressing the uniform grout method systems may be as follows. The basic system, may comprise a plurality of predimensioned rectangular first length thin surface units substantially having a first length and a unit width; and a plurality of predimensioned rectangular second length thin surface units having a second length and the unit width; wherein one fourth of the second length less seventy-five percent of a uniform thin surface unit design separation width may be substantially equal to one half of the first length less fifty percent the uniform thin surface unit design separation width and substantially equal to the unit width. This basic system may further comprise a plurality of $n^{th}$ length thin surface units having a $n^{th}$ length and the unit width, wherein the $n^{th}$ length divided by two, divided by n, less a quantity of two times n, less one, divided by two, divided by n, times the uniform thin surface unit design separation width may be substantially equal to the unit width. The basic embodiment may further comprise a plurality of predimensioned rectangular third length thin surface units having a third length and the unit width, wherein one-sixth of the third length less eighty-three and one third percent of a uniform thin surface unit design separation width may be substantially equal to the unit width. This three length system may further comprise a plurality of predimensioned rectangular fourth length thin surface units having a fourth length and the unit width, wherein substantially one eighth of the fourth length minus seven-eighths of the uniform thin surface unit design separation width may be substantially equal to the unit width.

Uniform Grout Width Equations:

$$0.25L_2-0.75W_{uds}=0.5L_1-0.5W_{uds}=W_u$$

$$L_n/2n-((2n-1)/2n)W_{uds}=W_u$$

$$L_3/6-0.8333W_{uds}=W_u$$

$$L_4/8-0.875W_{uds}=W_u$$

Where:

$W_u$=thin surface unit width $W_{uds}$=uniform thin surface unit design separation width $L_1$=first length $L_2$=second length $L_3$=third length $L_4$=fourth length $L_n$=$n^{th}$ length A number of each the predimensioned rectangular first length thin surface units, the predimensioned rectangular second length thin surface units, the predimensioned rectangular third length thin surface units and the predimensioned rectangular fourth length thin surface units of the four length system may be approximately twenty-five percent the total number of installed thin surface units. A number of each the predimensioned rectangular first length thin surface units, the predimensioned rectangular second length thin surface units, and the predimensioned rectangular third length thin surface units of the three length system may be approximately one-hundred divided by three percent the total number of installed thin surface units. A number of each the predimensioned rectangular first length thin surface units, the predimensioned rectangular second length thin surface units, and so on, to and including the predimensioned rectangular $n^{th}$ length thin surface units, in the n length system may be approximately one-hundred divided by n percent of the total number of installed thin surface units. For purposes of clarity and as but one example, if n were 5, then one-hundred divided by n percent would be twenty percent.

In any of the above embodiments, the first length may be approximately equal to eleven and seven-eighths inches, the second length may be approximately equal to twenty-three and seven-eighths inches, the third length may be approximately equal to thirty-five and seven eighths inches, and/or the fourth length may be approximately equal to forty-seven and seven-eighths inches. In any of the above embodiments, the unit width may be approximately equal to five and seven-eighths inches. Again, this recitation of specific distances is not intended as limiting, as other distances (lengths, widths, etc.) are possible and are contemplated by the invention. Any of the above systems may further comprise square thin surface units. Any surface having a surface system as described in any of the above systems is itself contemplated as an embodiment of the invention.

Methods corollary to the above-mentioned uniform thin surface unit design separation width (otherwise known as a uniform grout width) relationally sized thin surface unit surfacing (or surface) system may be as follows: A basic system may comprise the steps of predimensioning a plurality of rectangular first length thin surface units to each have a unit width and a first length and so that a total of twice the unit width plus a uniform thin surface unit design separation width may be substantially equal to the first length; predimensioning a plurality of rectangular second length thin surface units to each have the unit width and a second length and so that a total of four times the unit width plus three times the uniform thin surface unit design separation width may be substantially equal to the second length; and fixedly establishing the thin surface units to create a surface. This system may further comprise the step of predimensioning a plurality of rectangular $n^{th}$ length thin surface units to each have a unit width and a $n^{th}$ length and so that the $n^{th}$ length may be substantially equal to a sum of two times n, less one, times the uniform thin surface unit design separation width, plus a quantity two times n times the unit width (where in this case n is three or greater).

The basic uniform grout width method may further comprise the step of predimensioning a plurality of rectangular third length thin surface units to each have the unit width and a third length and so that a total of six times the unit width plus five times the uniform thin surface unit design separation width may be substantially equal to the third length. The three length method may further comprise the step of predimensioning a plurality of rectangular fourth length thin surface units to each have the unit width and a fourth length and so that a total of eight times the unit width plus seven times the uniform thin surface unit design separation width may be substantially equal to the fourth length. The step of fixedly establishing the thin surface units to create a surface as in the basic method may comprise the step of fixedly establishing a first substantially one-half of the thin surface units using the plurality of rectangular first length thin surface units and the step of fixedly establishing a second substantially one-half of the thin surface units using the plurality of rectangular second length thin surface units. The step of fixedly establishing the thin surface units to create a surface as in the three length method above may comprise the step of fixedly establishing a first substantially one-third of the thin surface units using the plurality of rectangular first length thin surface units, the step of fixedly establishing a second substantially one-third of the thin surface units using the plurality of rectangular second length thin surface units and the step of fixedly establishing a third substantially one-third of the thin surface units using the plurality of rectangular third length thin surface units. The step of fixedly establishing the thin surface units to create a surface as in the n length system above may comprise the step of fixedly establishing a first substantially one-fourth of the thin surface units using the plurality of rectangular first length thin surface units, the step of fixedly establishing a second substantially one-fourth of the thin surface units using the plurality of rectangular second length thin surface units, the step of fixedly establishing a third substantially one-fourth of the thin surface units using the plurality of rectangular third length thin surface units and the step of fixedly establishing a fourth substantially one-fourth of the thin surface units using the plurality of rectangular fourth length thin surface units. Any of the above methods may further comprise the step of predimensioning a plurality of square thin surface units. A surface made using this "square thin surface unit method" or any of the other above-mentioned methods is also contemplated by this invention.

Figure 11:
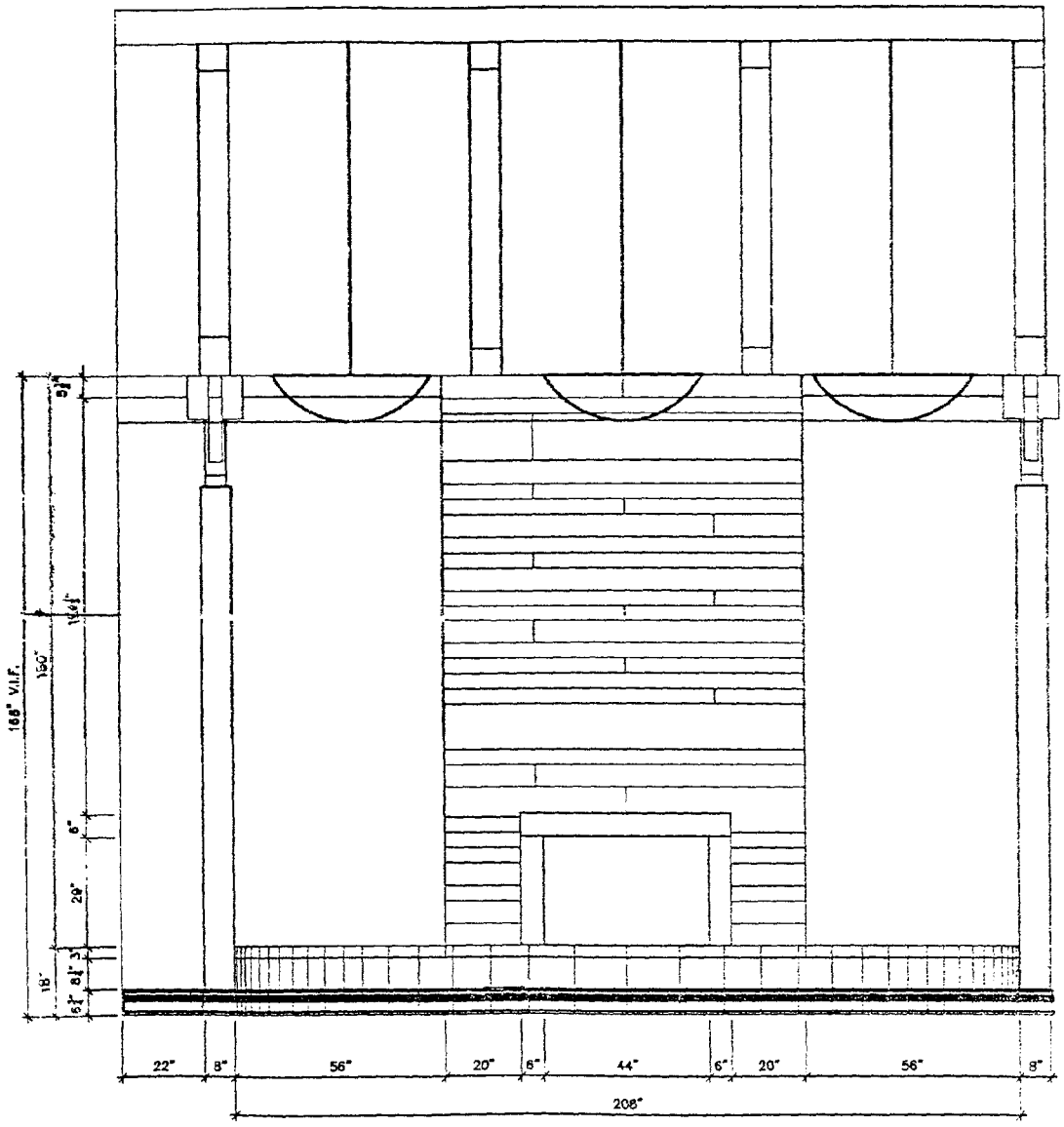
FIG. 11 shows a view of a possible construction incorporating a multi-width surface unit design pattern.
Figure 12:
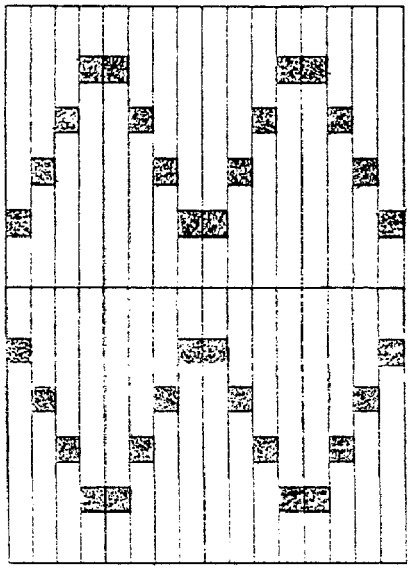
FIG. 12 shows design pattern #PL66.
Figure 13:
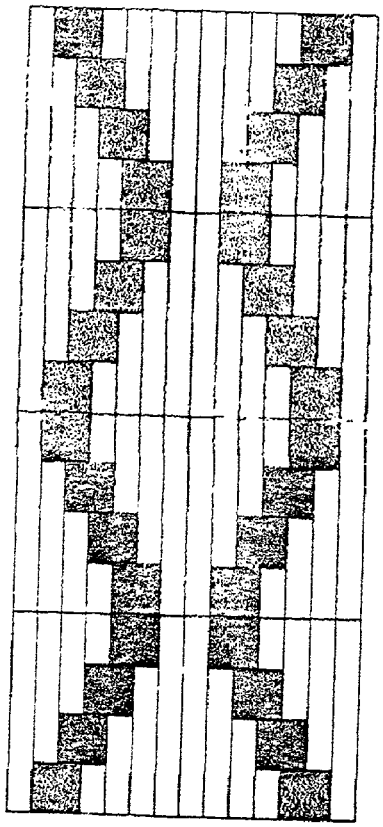
FIG. 13 shows design pattern #PL11.
Figure 14:
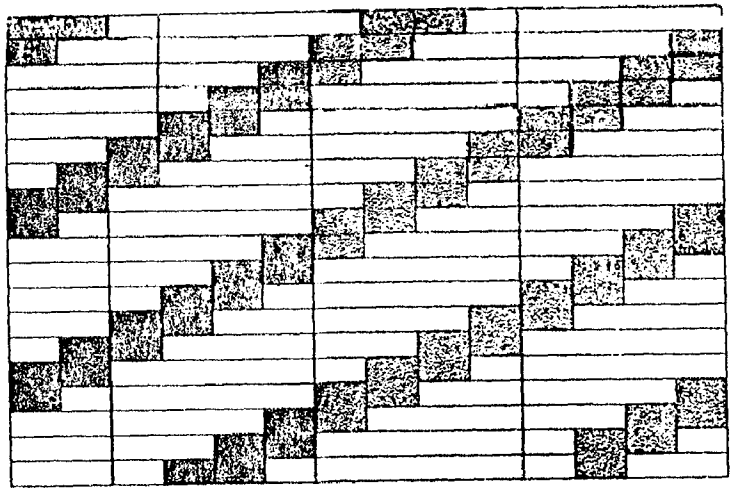
FIG. 14 shows design pattern #PL11D.
Figure 15:
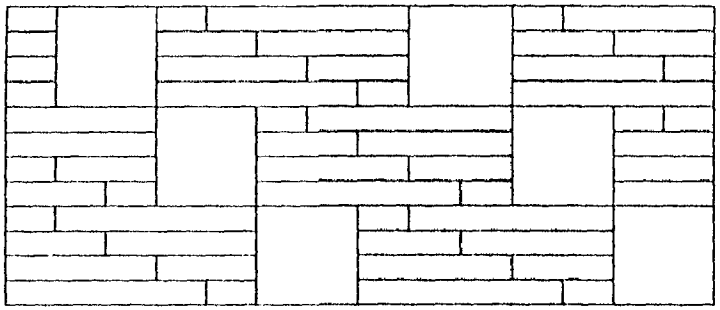
FIG. 15 shows design pattern #PL22.
Figure 16:
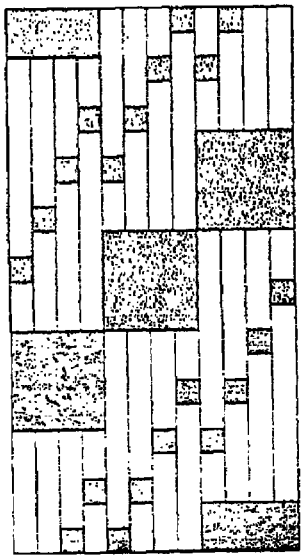
FIG. 16 shows design pattern #PL2266.
Figure 17:
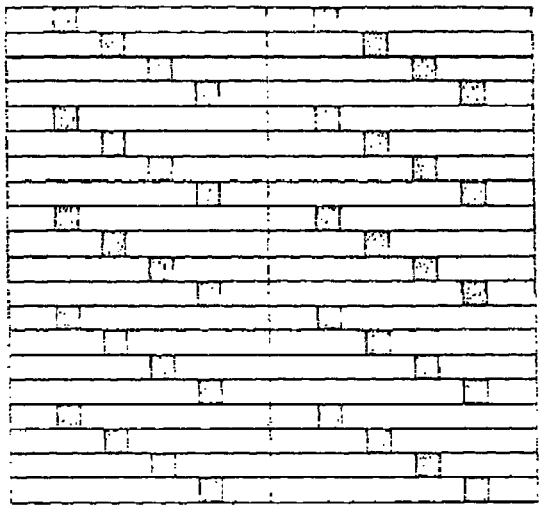
FIG. 17 shows design pattern #PL66D.
Figure 18:
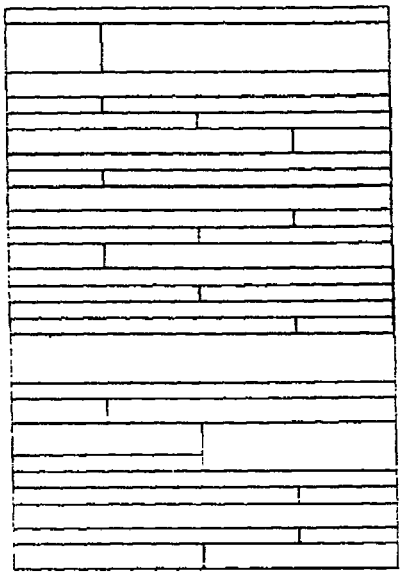
FIG. 18 shows design pattern #14 (a multi-width design).
Figure 19:
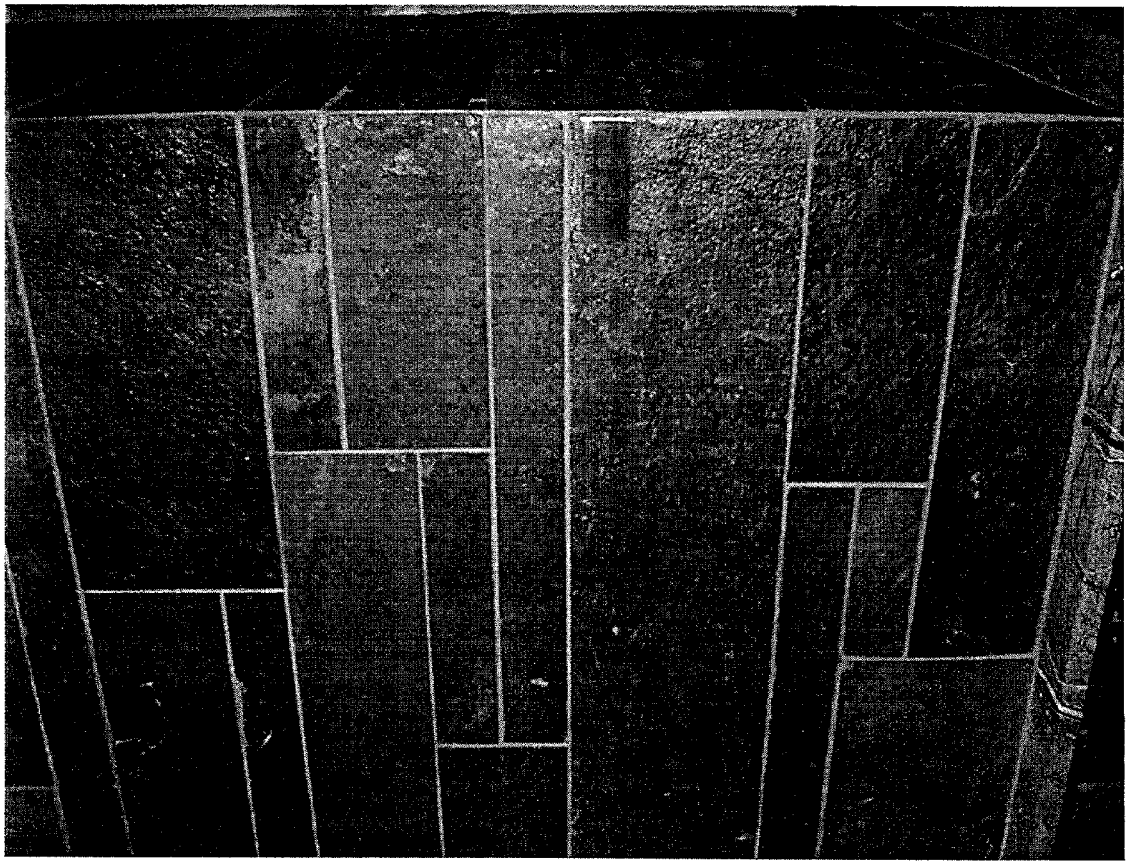
FIG. 19 shows a multi-width surface unit design surface.
Figure 22:
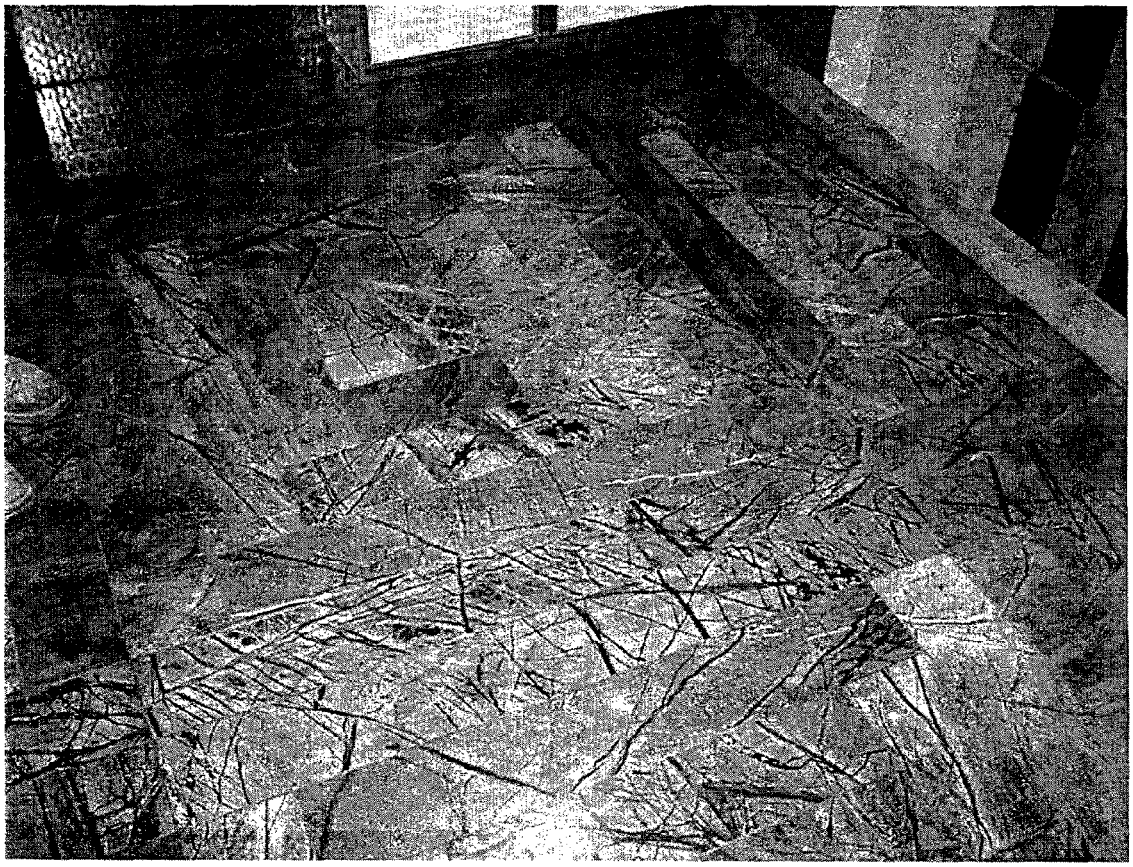
FIG. 22 shows a surface constructed according to design pattern #1.
Figure 23:
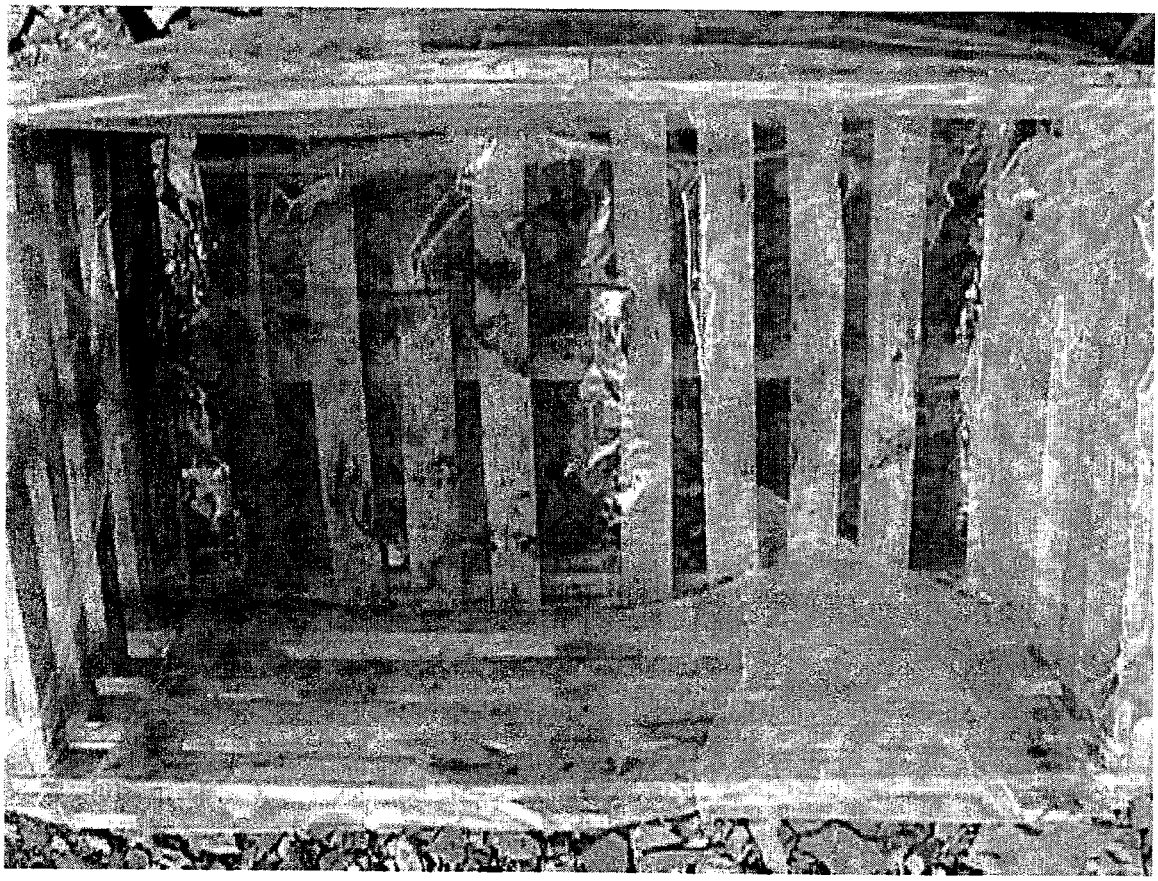
FIG. 23 is a photograph showing top view of an empty crate.
Figure 24:
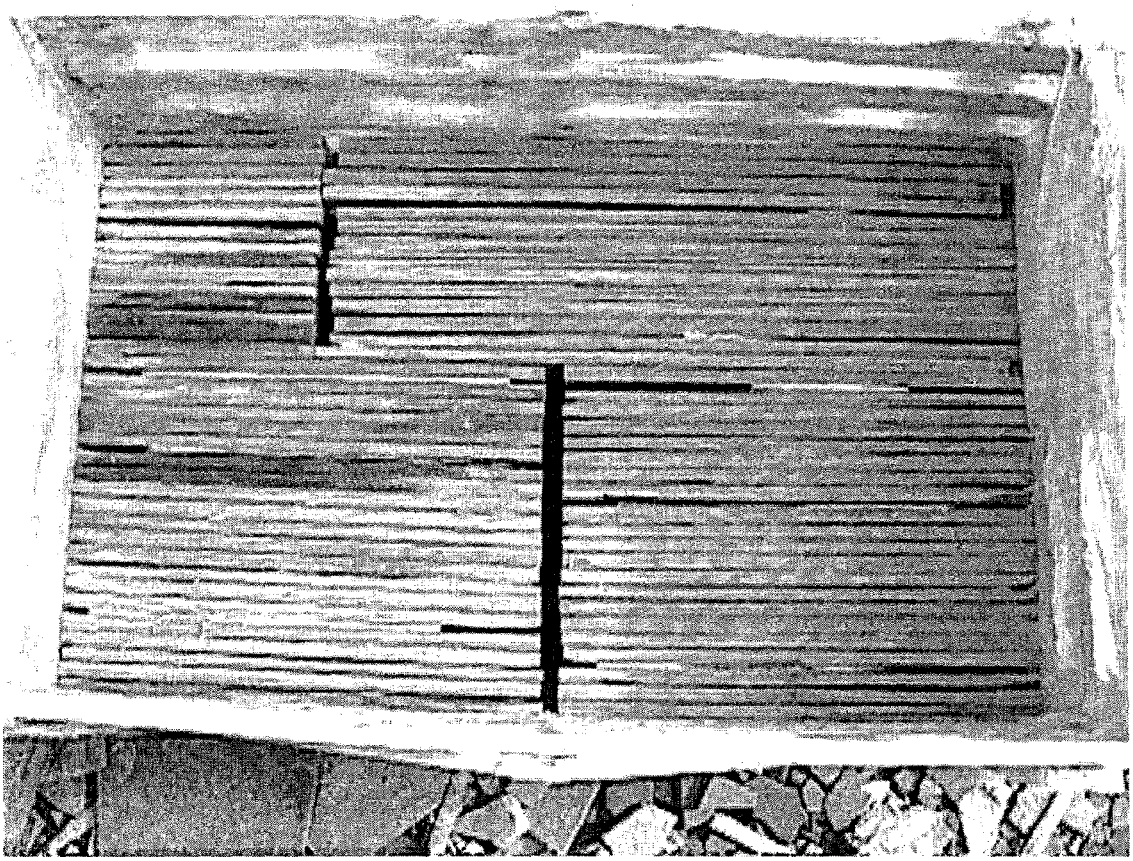
FIG. 24 is a photograph showing a lowest thin surface unit layer, in addition to horizontally edge stacked first, second and third length thin stone surface units.
Figure 25:
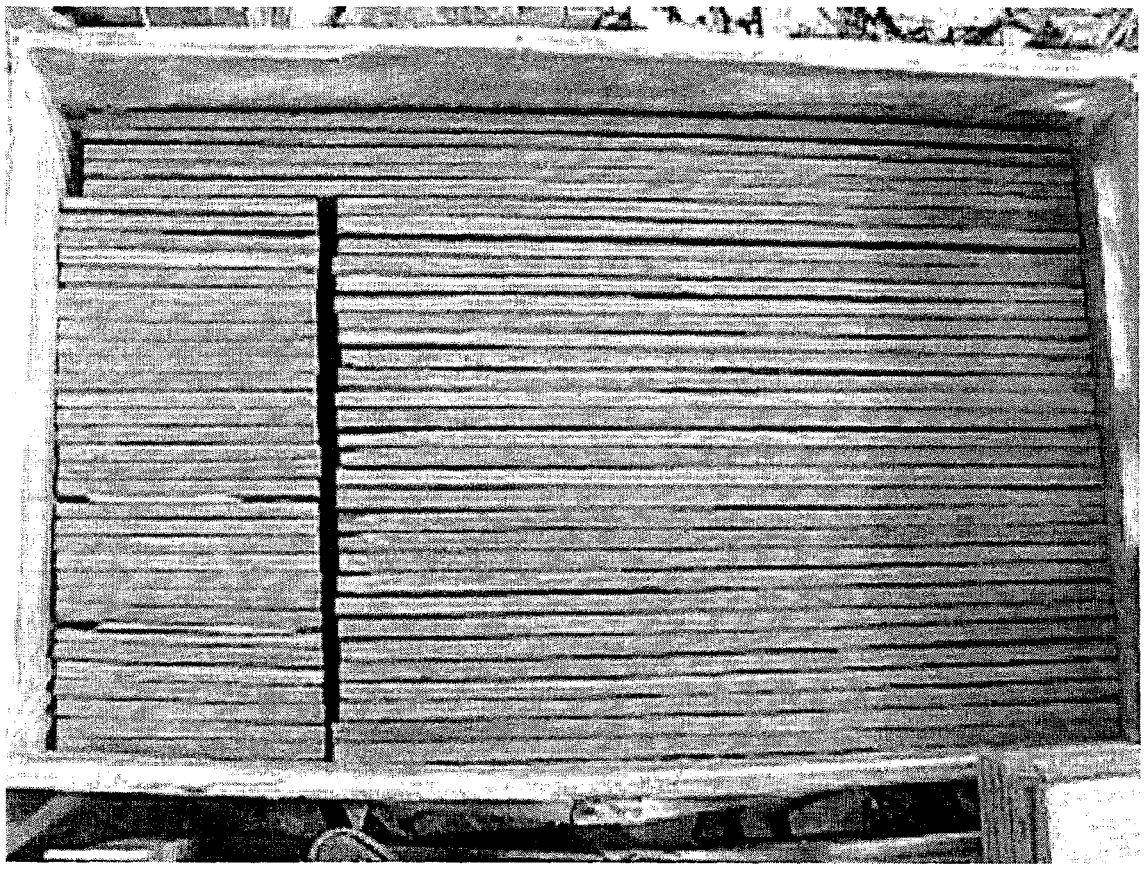
FIG. 25 is a photograph showing a middle thin surface unit layer, in addition to horizontally edge stacked first, third and fourth length thin stone surface units.

The uniform and non-uniform grout width (or thin surface unit design separation widths) may involve thin surface units that have equal widths in a set of embodiments (or systems). An alternative set of systems of the present invention involves thin surface units that may have three different widths. In a preferred embodiment, a first width may be approximately three times a third width and approximately one and one-half times a second width. Each of those widths may or may not have thin surface units that have different lengths. Substantially (or approximately) twenty percent of the thin surface units may have the first width, substantially forty percent of the thin surface units may have the second width, and substantially forty percent of the thin surface units may have the third width. FIG. 22 shows a view of a possible construction incorporating a multi-width surface unit design pattern; FIG. 18 shows a multi-width design blueprint, FIG. 19 shows a multi-width surface unit design surface and FIG. 11 shows a view of a possible construction incorporating a multi-width surface unit design pattern. Of course these are but a few examples of a multi-width system.

The basic multi-width surface system may comprise a plurality of predimensioned rectangular first width thin surface units having a first width; a plurality of predimensioned rectangular second width thin surface units having a second width; and a plurality of predimensioned rectangular third width thin surface units having a third width; wherein the first width less a cut width (which may be that surfacing material width of a first width thin surface unit that is lost when the first width unit is cut to create the second and third width units; the cut width may be approximately one-eighth inch or other lengths) may be approximately three times the third width and the first width less approximately one eight inch may be approximately one and one-half times the second width. The first width may be the widest of the widths and substantially twenty percent of the predetermined rectangular thin surface units may have the first width. Also, substantially forty percent of the predetermined rectangular thin surface units may have the second width. Further, substantially forty percent of the predetermined rectangular thin surface units may have the third width.

The predimensioned rectangular first width thin surface units of any of the above systems may comprise units having a first length and a second length; the predimensioned rectangular second width thin surface units may comprise units having the first length and the second length; and the predimensioned rectangular third width thin surface units may comprise units having the first length and the second length. The predimensioned rectangular first width thin surface units of any of the above systems may further comprise units having a $n^{th}$ length, wherein the predimensioned rectangular second width thin surface units may further comprise units having the $n^{th}$ length and wherein the predimensioned rectangular third width thin surface units may further comprise units having the $n^{th}$ length. Relative to the n length system, a number of each the predimensioned rectangular first width thin surface units having the first length, the predimensioned rectangular first width thin surface units having the second length, and so on, to and including the predimensioned rectangular first width thin surface units having the $n^{th}$ length, may be approximately one-hundred divided by n percent of the total number of predimensioned rectangular first width thin surface units; wherein a number of each the predimensioned rectangular second width thin surface units having the first length, the predimensioned rectangular second width thin surface units having the second length, and so on, to and including the predimensioned rectangular second width thin surface units having the $n^{th}$ length may be approximately one-hundred divided by n percent of the total number of predimensioned rectangular second width thin surface units; and wherein a number of each the predimensioned rectangular third width thin surface units having the first length, the predimensioned rectangular third width thin surface units having the second length, and so on, to and including the predimensioned rectangular third width thin surface units having the $n^{th}$ length may be approximately one-hundred divided by n percent the total number of predimensioned rectangular third width thin surface units.

This n-length, n-based percentage system may have strictly three different lengths of each the predimensioned rectangular first width thin surface units, the predimensioned rectangular second width thin surface units, and the predimensioned rectangular third width thin surface units. The n-length, n-based percentage method may also have strictly four different lengths of each the predimensioned rectangular first width thin surface units, the predimensioned rectangular second width thin surface units, and the predimensioned rectangular third width thin surface units. In any of the above mentioned systems, the first width may be approximately five and seven-eighths inches, the second width may be approximately three and five-sixths inches and the third width may be approximately one and eleven-twelfths inches. In any of the above mentioned systems, the first width may be approximately twelve inches, the second width may be approximately eight inches and the third width may be approximately four inches. In any of the above-mentioned systems, the first width may be approximately five and seven eighths inches, the second width may be approximately three and five sixths inches and the third width may be approximately one and eleven-twelfths inches. In any of the above mentioned systems, the first width may be approximately twelve inches, the second width may be approximately eight inches and the third width may be approximately four inches. In any of the above-mentioned multi-length systems, the first length alone may be approximately twelve inches. In any of the above-mentioned multi-length systems, the second length alone may be approximately twenty-four inches. In any of the above-mentioned multi-length systems having at least three lengths, the third length may be approximately thirty-six inches. In any of the above-mentioned multi-length systems having at least four lengths, the fourth length may be approximately forty-eight inches. In any of the above-mentioned multi-length systems having at least four lengths, the fourth length may be substantially four times the first length, substantially twice the second length and substantially four-thirds times the third length. Any of the above systems may also include square thin surface units. A surface made using any of the above-mentioned methods is contemplated as part of the invention.

Methods corollary to the above apparatus may be as follows: A basic method may comprise the steps of predimensioning a plurality of rectangular first width thin surface units to have a first width; predimensioning a plurality of rectangular second width thin surface units to have a second width that may be substantially two-thirds the quantity the first width less a cut width (which may be approximately one-eighth inch, among other lengths); and predimensioning a plurality of rectangular third width thin surface units to have a third width that may be substantially one-half the second width. The step of predimensioning a plurality of rectangular first width thin surface units to have a first width in this basic method may comprise the step of predimensioning so that approximately twenty percent of all rectangular thin surface units have the first width; the step of predimensioning a plurality of rectangular second width thin surface units to have a second width may comprise the step of predimensioning so that approximately forty percent of the all rectangular thin surface units have the second width; and the step of predimensioning a plurality of rectangular third width thin surface units to have a third width may comprise the step of predimensioning so that approximately forty percent of all rectangular thin surface units have the third width (this method may be referred to as the forty-forty-twenty method). The step of predimensioning a plurality of rectangular first width thin surface units of either of the above methods may further comprise the step of predimensioning to have two lengths. The step of predimensioning a plurality of rectangular second width thin surface units of the preceding method may further comprise the step of predimensioning to have the two lengths. The step of predimensioning a plurality of rectangular third width thin surface units of the preceding method may further comprise the step of predimensioning to have the two lengths. The step of the preceding method of predimensioning a plurality of the rectangular first width thin surface units to have a first width and two lengths may further comprise the step of predimensioning so that a number of each the predimensioned rectangular first width thin surface units having the first length, and the predimensioned rectangular first width thin surface units having the second length may be approximately fifty percent of the total number of predimensioned rectangular first width thin surface units; wherein the step of predimensioning a plurality of the rectangular second width thin surface units to have a second width and the two lengths may further comprise the step of predimensioning so that a number of each the predimensioned rectangular second width thin surface units having the first length and the predimensioned rectangular second width thin surface units having the second length may be approximately fifty percent of the total number of predimensioned rectangular second width thin surface units; and wherein the step of predimensioning a plurality of the rectangular third width thin surface units to have a second width and the two lengths may further comprise the step of predimensioning so that a number of each the predimensioned rectangular third width thin surface units having the first length and the predimensioned rectangular third width thin surface units having the second length may be approximately fifty percent the total number of predimensioned rectangular third width thin surface units.

The step of the basic method (or of the forty-forty-twenty method above) of predimensioning a plurality of rectangular first width thin surface units may further comprise the step of predimensioning to have three lengths. The step of this method of predimensioning a plurality of rectangular second width thin surface units may further comprise the step of predimensioning to have these three lengths. The step of this preceding method of predimensioning a plurality of rectangular third width thin surface units may further comprise the step of predimensioning to have these three lengths. The step of this preceding method of predimensioning a plurality of the rectangular first width thin surface units to have a first width and three lengths may further comprise the step of predimensioning so that a number of each the predimensioned rectangular first width thin surface units having the first length, the predimensioned rectangular first width thin surface units having the second length, and the predimensioned rectangular first width thin surface units having the third length may be approximately one-hundred divided by three percent of the total number of predimensioned rectangular first width thin surface units; wherein the step of predimensioning a plurality of the rectangular second width thin surface units to have a second width and the three lengths may further comprise the step of predimensioning so that a number of each the predimensioned rectangular second width thin surface units having the first length, the predimensioned rectangular second width thin surface units having the second length, and the predimensioned rectangular second width thin surface units having the third length may be approximately one-hundred divided by three percent of the total number of predimensioned rectangular second width thin surface units; and wherein the step of predimensioning a plurality of the rectangular third width thin surface units to have a second width and the three lengths may further comprise the step of predimensioning so that a number of each the predimensioned rectangular third width thin surface units having the first length, the predimensioned rectangular third width thin surface units having the second length and the predimensioned rectangular third width thin surface units having the third length may be approximately one-hundred divided by three percent the total number of predimensioned rectangular third width thin surface units.

The step of the basic method (or of the forty-forty-twenty method above) of predimensioning a plurality of rectangular first width thin surface units may further comprise the step of predimensioning to have four lengths. The step of the preceding method of predimensioning a plurality of rectangular second width thin surface units may further comprise the step of predimensioning to have the four lengths. The step of the preceding method of predimensioning a plurality of rectangular third width thin surface units may further comprise the step of predimensioning to have the four lengths. The step of the preceding method of predimensioning a plurality of the rectangular first width thin surface units to have a first width and four lengths may further comprise the step of predimensioning so that a number of each the predimensioned rectangular first width thin surface units having the first length, the predimensioned rectangular first width thin surface units having the second length, the predimensioned rectangular first width thin surface units having the third length and the predimensioned rectangular first width thin surface units having the fourth length may be approximately twenty-five percent of the total number of predimensioned rectangular first width thin surface units; wherein the step of predimensioning a plurality of the rectangular second width thin surface units to have a second width and the four lengths may further comprise the step of predimensioning so that a number of each the predimensioned rectangular second width thin surface units having the first length, the predimensioned rectangular second width thin surface units having the second length, the predimensioned rectangular second width thin surface units having the third length, and the predimensioned rectangular second width thin surface units having the fourth length may be approximately twenty-five percent of the total number of predimensioned rectangular second width thin surface units; and wherein the step of predimensioning a plurality of the rectangular third width thin surface units to have a second width and the four lengths may further comprise the step of predimensioning so that a number of each the predimensioned rectangular third width thin surface units having the first length, the predimensioned rectangular third width thin surface units having the second length, the predimensioned rectangular third width thin surface units having the third length and the predimensioned rectangular third width thin surface units having the fourth length may be approximately twenty-five percent the total number of predimensioned rectangular third width thin surface units.

The step of the basic method (or of the forty-forty-twenty method above) of predimensioning a plurality of the rectangular first width thin surface units to have a first width and a plurality of lengths may further comprise the step of predimensioning to have n lengths; wherein the step of predimensioning a plurality of the rectangular second width thin surface units to have a second width and the plurality of lengths may further comprise the step of predimensioning to have the n lengths; wherein the step of predimensioning a plurality of the rectangular third width thin surface units to have a third width and the plurality of lengths may further comprise the step of predimensioning to have the n lengths. The step of the preceding method of predimensioning a plurality of the rectangular first width thin surface units to have a first width and n lengths may further comprise the step of predimensioning so that a number of each the predimensioned rectangular first width thin surface units having the first length, and so on, to and including the predimensioned rectangular first width thin surface units having the $n^{th}$ length may be approximately one-hundred divided by n percent of the total number of predimensioned rectangular first width thin surface units; wherein the step of predimensioning a plurality of the rectangular second width thin surface units to have a second width and the n lengths may further comprise the step of predimensioning so that a number of each the predimensioned rectangular second width thin surface units having the first length, and so on, to and including the predimensioned rectangular second width thin surface units having the $n^{th}$ length may be approximately one-hundred divided by n percent of the total number of predimensioned rectangular second width thin surface units; and wherein the step of predimensioning a plurality of the rectangular third width thin surface units to have a second width and the n lengths may further comprise the step of predimensioning so that a number of each the predimensioned rectangular third width thin surface units having the first length, and so on, to and including the predimensioned rectangular third width thin surface units having the $n^{th}$ length may be approximately one-hundred divided by n percent of the total number of predimensioned rectangular third width thin surface units. A surface made using any of the above-mentioned methods is contemplated as part of the invention.

The invention also contemplates an efficient system for packaging surfacing units of different lengths (see, generally, FIGS. 23-27). A basic apparatus may comprise a box-type crate (see FIG. 23) having an internal crate width, an internal crate length, and an internal crate height; a plurality of crated side-packed thin surface units that may comprise a plurality of first length thin surface units having a first length, a thin surface unit width and a thin surface unit height, a plurality of second length thin surface units each having a second length, substantially having the thin surface unit width, and substantially having the thin surface unit height, a plurality of third length thin surface units each having a third length, substantially having the thin surface unit width and substantially having the thin surface unit height, and a plurality of fourth length thin surface units each having a fourth length, substantially having the thin surface unit width and substantially having the thin surface unit height; wherein the second length may be substantially twice the first length, the third length may be substantially three times the first length, and the fourth length may be substantially four times the first length; wherein the internal crate height less a vertical padding thickness may be substantially an integer multiple (one times, two times, three times, etc.) of the thin surface unit width, the internal crate length less a longitudinal padding thickness may be at least a maximum crated thin surface unit length and may be substantially an integer multiple of the first length. The term "crated side-packed thin surface units" refers to thin surface units (or surface elements) that, when packed in a crate, may be packed so that a directional vector normal to each planar face of the majority of thin surface units may be substantially horizontal. In other words, two of the four edges (note that the term edge as used herein refers generally not to a ninety degree "L" edge, but instead to a "one-hundred eighty degree" "[" shaped edge) of the thin surface units may be vertically aligned while the remaining two edges may be horizontally aligned.

To arrive at what may be termed the "layer apparatus", this basic packaging system may further comprise a plurality of crated side-packed thin surface unit layers that each may have a crated side-packed thin surface unit layer length; wherein the plurality of crated side-packed thin surface unit layers may comprise: a top thin surface unit layer within the crate that may comprise only fourth length thin surface units (see FIG. 26); and a plurality of lower thin surface unit layers disposed within the crate wherein each lower thin surface unit layer may comprise a horizontally edge-to-edge packed thin surface unit combination selected from the group consisting of: at least four first length thin surface units, a plurality of second length thin surface units, a plurality of first length thin surface units and one second length thin surface units, and at least a third length thin surface unit and one first length thin surface unit. In either of the two above systems, the vertical padding thickness may comprise a top vertical padding thickness, a bottom vertical padding thickness and a intermediate vertical padding thickness. In either of the above apparatus, the longitudinal padding thickness may comprise a first end padding thickness and a second end padding thickness. It may also comprise an intermediate longitudinal padding thickness (e.g., that may exist between horizontally edge stacked surface units). In the layer apparatus or any of the apparatus based on it, the internal crate length less the longitudinal padding thickness may be substantially equal to a maximum end-to-end single layer thin surface unit length. In the layer apparatus or any of the apparatus based on it the internal crate length may be substantially equal to each of the crated side-packed thin surface unit layer lengths. In the layer apparatus or any of the apparatus based on it, the group further consists of a plurality of third length thin surface units. In the layer apparatus or any of the apparatus based on it the plurality of lower thin surface unit layers may comprise a middle thin surface unit layer (see FIG. 25) and a lowest thin surface unit layer (see FIG. 24) (this is the three layer apparatus).

Figure 26:
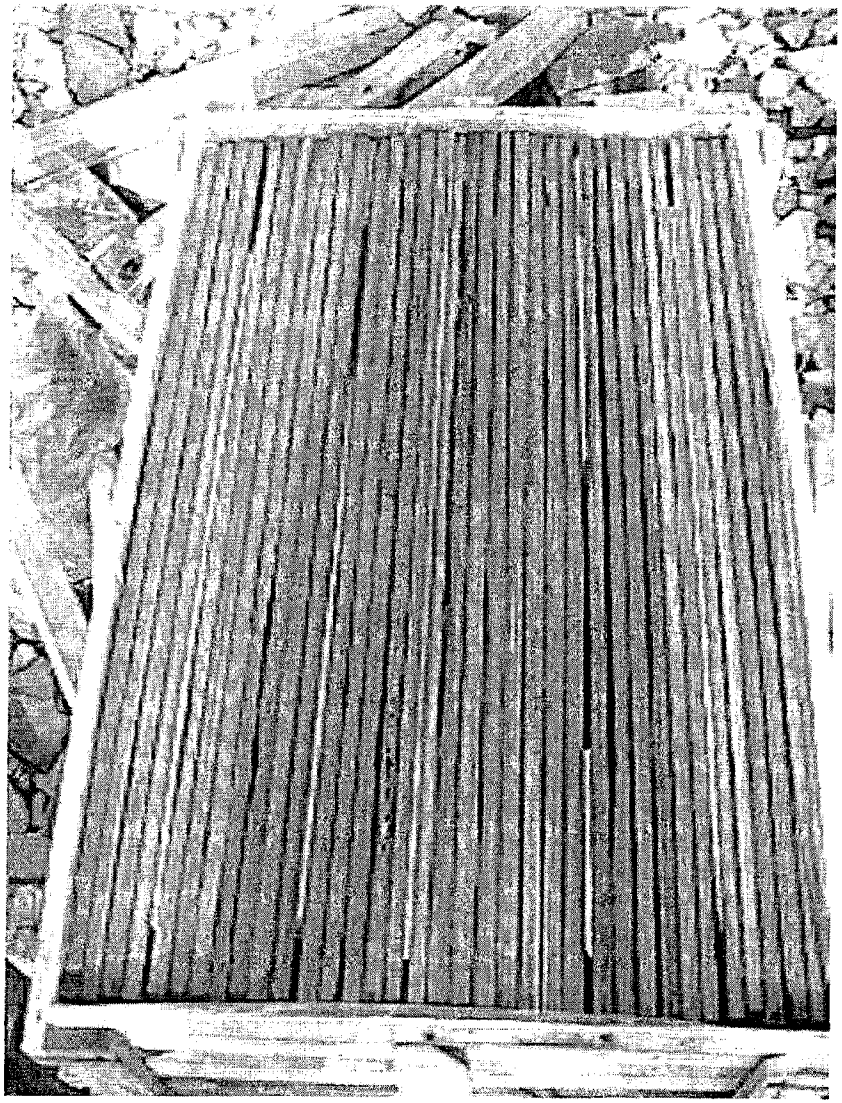
FIG. 26 is a photograph showing a top thin surface unit layer as comprising only maximum length thin stone surface units.

In the layer (three or otherwise) packaging apparatus or any of the apparatus based on it the top thin surface unit layer may comprise only fourth length thin surface units (see FIG. 26). In the three layer apparatus or any of the apparatus based on it, the top thin surface unit layer may comprise substantially thirty-one fourth length thin surface units, the lower thin surface unit layer may comprise substantially forty-two second length thin surface units, substantially sixteen third length thin surface unit layers and substantially sixteen first length thin surface units, and the middle thin surface unit layer may comprise substantially twenty-six the first length thin surface units, substantially twenty-six the third length thin surface unit layers, and substantially eleven of the fourth length thin surface unit layers. In the three layer apparatus or any of the apparatus that are based on it, the lowest thin surface unit layer may comprise all crated second length thin surface units and at least a portion of each the third length thin surface units and the first length thin surface units. In the three layer apparatus or any of the apparatus that are based on it, the middle thin surface unit layer may comprise at least a portion of the first, second and fourth length thin surface units. In any of the preceding apparatus, substantially twenty-five percent of all the crated side-packed thin surface units may be first length thin surface units, substantially twenty-five percent of all the crated side-packed thin surface units may be second length thin surface units, substantially twenty-five percent of all the crated side-packed thin surface units may be third length thin surface units and substantially twenty-five percent of all the crated side-packed thin surface units may be fourth length thin surface units. A horizontally edge-to-edge stacked (or packed) thin surface unit combination refers to side-packed thin surface units occupying any given layer whose vertical edges (as packed) may contact or are in close proximity to one another (except for the edges that may contact the padding of the crate) so as to occupy the entire (ideally) internal length of the crate (see, generally, FIGS. 24 and 25). Expressed another way, the term refers to the arrangement of side-packed surface elements along the length of the crate in an edge-to-edge fashion (presuming the internal crate length less a longitudinal padding thickness may be greater than or equal to a maximum crated thin surface unit length). For example, if an internal crate length less a longitudinal padding thickness is approximately forty-eight inches, then four horizontally edge-to-edge packed (or stacked) one-foot thin surface units may be arranged to occupy a portion of that length (specifically a thin surface unit thickness portion of it).

Figure 27:
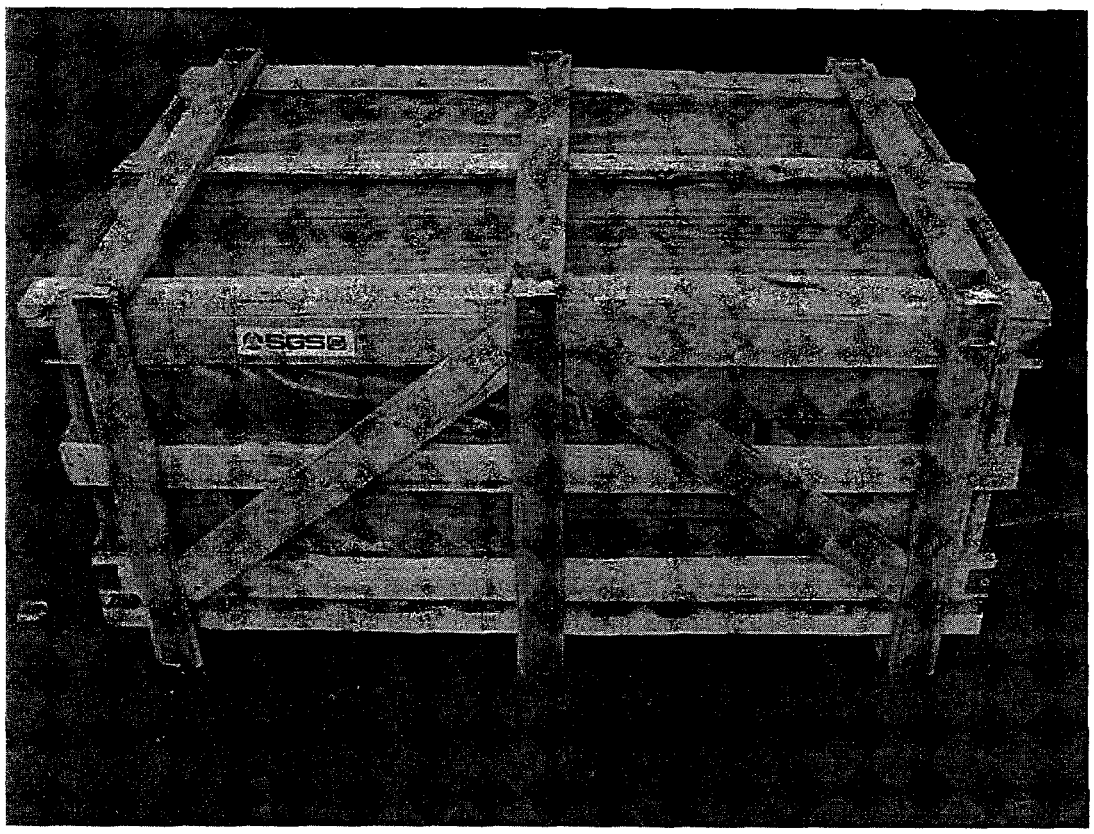
FIG. 27 is a photograph showing a crate prepared for shipment.

Note that internal crate length, width and height are general terms. Internal crate length may be generally defined as that crate dimension that along which the lengths of the crated surface elements may be aligned. Internal crate width may be defined generally as that crate dimension along which the thickness of the crated thin surface units may be aligned; internal crate height may be defined generally as that crate dimension along which the width of the crated thin surface units may be aligned. A vertical padding thickness generally refers to the thickness along a vertical axis of any padding that serves to cushion gravity induced forces (note that at least a portion of this padding thickness may be thickness of padding compressed by gravity induced forces); a longitudinal padding thickness generally refers to the thickness along the crate length of an padding that may be designed to cushion forces that act along the crate length. Note that padding may conceivably be a part of the crate itself; in such a case, it may still be used to define a dimension that may be subtracted from a redefined internal crate length to determine the longitudinal space available for crated surface elements because in such a case the crate may be defined to include only the non-padding portion. Note that any packaging system may be for containing a more specific or different type of surface unit (e.g., although the above description is for containing thin surface units, the invention contemplates containing also quarried material thin surface units, stone surface units and surface units in general. Further, any of the packaging systems may be for containing a plurality of any type of substantially rectangular elements (whether thin or not), instead of limited to containing surface units. FIG. 27 shows a crate prepared for shipment. The specification list in the attached Examples includes more detail on the padding aspects of the packaging system.

Methods corollary to the above apparatus may be as follows: A packaging method may comprise the steps of: obtaining a plurality of each first length thin surface units having a first length, a thin surface unit width and a thin surface unit height, second length thin surface units having a second length, substantially having the thin surface unit width and substantially having the thin surface unit height, third length thin surface units having a third length, substantially having the thin surface unit width and substantially having the thin surface unit height, and fourth length thin surface units having a fourth length, substantially having the thin surface unit width and substantially having the thin surface unit height wherein the second length may be substantially twice the first length, the third length may be substantially three times the first length, and the fourth length may be approximately four times the first length; establishing a bottom thin surface unit layer in a crate having a rectangular solid internal surface with an internal crate length, an internal crate width, and an internal crate height; establishing at least one intermediate thin surface unit layer; vertically stacking the at least one intermediate thin surface unit layer directly above the bottom thin surface unit layer; vertically stacking directly above a highest intermediate thin surface unit layer the top thin surface unit layer; wherein the internal crate width less twice a first padding thickness may be substantially an integer multiple of the thin surface unit width, the internal crate length less twice a second padding thickness may be at least a maximum crated thin surface unit length and may be substantially an integer multiple of the first length, the internal crate height less a bottom padding thickness and less a top padding thickness may be substantially an integer multiple of the thin surface unit height. This basic method may further comprise the step of establishing a top thin surface unit layer from only at least a portion of the fourth length thin surface units.

Each the step of any of the above methods of establishing a bottom thin surface unit layer and establishing at least one intermediate thin surface unit layer may comprise a step selected from the group consisting of the steps of: horizontally edge stacking (or packing) at least four first length thin surface units, horizontally edge stacking a plurality of second length thin surface units, horizontally edge stacking a plurality of first length thin surface units and at least one second length thin surface units, and horizontally edge stacking at least a third length thin surface unit and at least one first length thin surface unit. In any of the above methods, the step of establishing at least one intermediate thin surface unit layer may comprise the step of establishing one intermediate thin surface unit layer. In any of the above methods, the step of establishing at least one intermediate thin surface unit layer may comprise the step of establishing one intermediate thin surface unit layer. In any of the above methods, the group may further consist of horizontally edge stacking a plurality of third length thin surface units. Each the vertical padding thickness and the longitudinal padding thickness may include an intermediate padding thickness. The intermediate vertical padding thickness may be the thickness of padding placed between thin surface unit layers. Instead of, or in addition to this intermediate vertical padding thickness, there may also exist a bottom padding thickness and/or a top padding thickness. Similarly, the longitudinal padding thickness may include an intermediate longitudinal padding thickness, and/or a first end padding thickness and/or a second end padding thickness. The intermediate longitudinal padding thickness may generally be protective packaging material placed between at least some of the respective side-packed thin surface units within any given layer. As used herein, two thin surface units (or their edges) may be said to abut even where their proximate edges (or the edges, if it is the edges that are said to abut) may be separated by a thin surface unit separation width (or a grout width); indeed, abutting, as used herein, may even require a lack of direct contact between the edges of the two abutting pieces (such as thin surface units). The same limitations on the term abut apply to the term abutting. FIGS. 23-27 may be helpful to an understanding of the above mentioned packaging methods and apparatus. Note that any of the above packaging systems or limitations may be limited to quarried material, surfacing units, or stone surfacing units, thin surfacing units, or combinations of the thereof, or instead may incorporate substantially rectangular elements (which may be entirely unrelated to surfacing technology).

Figure 2:
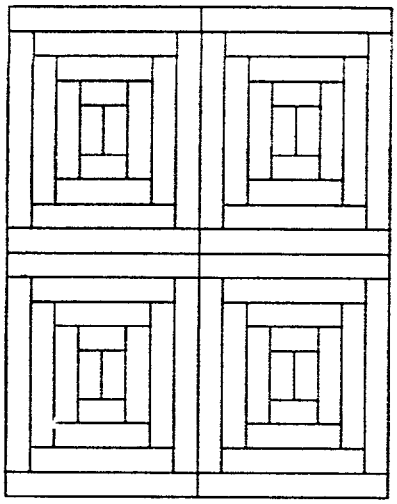
FIG. 2 shows design pattern #1 (or first design or first pattern).

Other related aspects of the invention are patterns that may be used in installing thin surface units to create a surface (see generally FIGS. 2-18). To create a basic first pattern from thin surface units having at least three different lengths, the plurality of predimensioned rectangular thin surface units of the apparatus of each the non-uniform grout width surface system and the uniform grout width surface system that involve three lengths of thin surface units may be relatively arranged in at least one repeatable installed thin surface unit pattern that may comprise two center leader first length thin surface units that abut one another along inner length edges to substantially form a square; two trailer first length thin surface units each having one inner length edge that abuts a width edge of each of the two center leader first length thin surface units; two leader second length thin surface units each having one inner length edge that abuts a width edge of each of the two trailer first length thin surface units and an outer length edge of one of the two center leader first length thin surface units; two trailer second length thin surface units each having one inner length edge that abuts a width edge of each the leader second length thin surface unit and an outer length edge of one of the two trailer first length thin surface units; two leader third length thin surface units each having one inner length edge that abuts a width edge of each of the two second length trailer thin surface units and an outer length edge of one of the two leader second length thin surface units; and two trailer third length thin surface units each having one inner length edge that abuts a width edge of each leader third length thin surface unit and an outer length edge of the trailer second length thin surface unit. FIG. 2 is useful to illustrate not only a four length first pattern system, but also first patterns made from fewer or more lengths.

Figure 8:
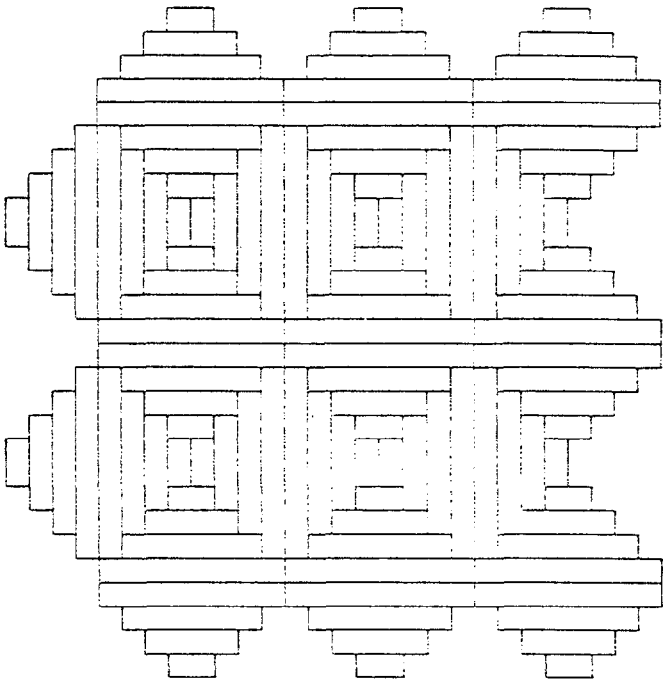
FIG. 8 shows design pattern #5.
Figure 9:
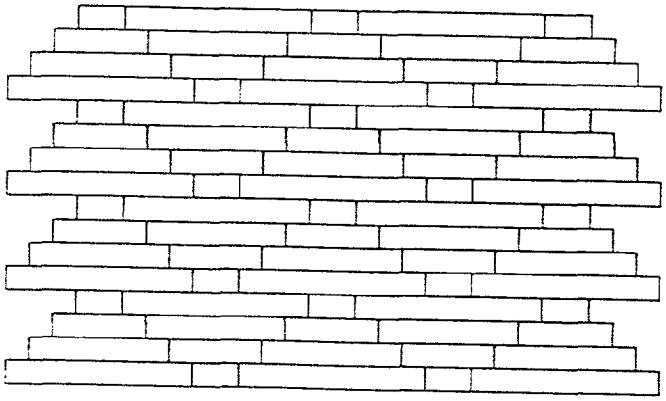
FIG. 9 shows design pattern #6.
Figure 10:
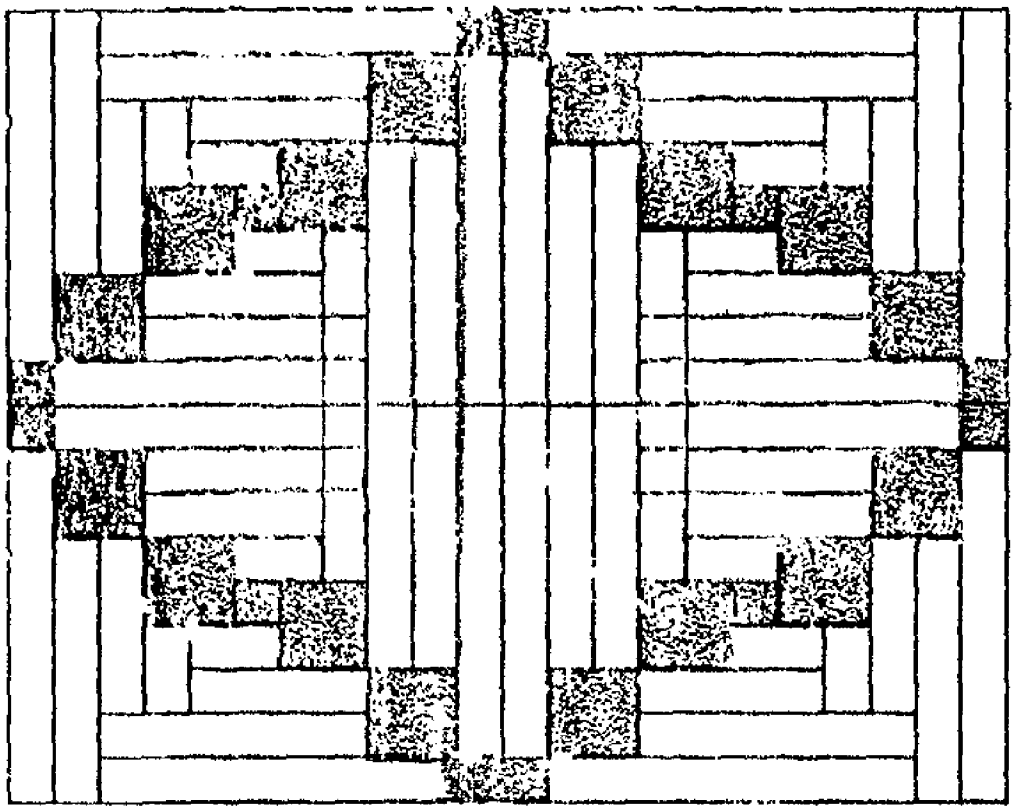
FIG. 10 shows design pattern #PL1166.

To create another basic first pattern from thin surface units having at least four different lengths (see FIG. 2), the plurality of predimensioned rectangular thin surface units of the apparatus of each the non-uniform grout width surface system and the uniform grout width surface system that involve four lengths of thin surface units may be relatively arranged in at least one repeatable installed thin surface unit pattern that may comprise two center leader first length thin surface units that each abut one another along inner length edges to substantially form a square; two trailer first length thin surface units each having one inner length edge that abuts a width edge of each of the two center leader first length thin surface units; two leader second length thin surface units each having one inner length edge that abuts a width edge of each of the two trailer first length thin surface units and an outer length edge of one of the two center leader first length thin surface units; two trailer second length thin surface units that each having one inner length edge that abuts a width edge of each the leader second length thin surface unit and an outer length edge of one of the two trailer first length thin surface units; two leader third length thin surface units that each have one inner length edge that abuts a width edge of each of the two second length trailer thin surface units and an outer length edge of one of the two leader second length thin surface units; two trailer third length thin surface units that each have one inner length edge that abuts a width edge of each leader third length thin surface unit and an outer length edge of the trailer second length thin surface unit; two leader fourth length thin surface units each having one inner length edge that abuts a width edge of each of the two third length trailer thin surface units and an outer length edge of one of the two leader third length thin surface units. This preceding apparatus may further comprise two trailer fourth length thin surface units each having one inner length edge that abuts a width edge of each leader fourth length thin surface unit and an outer length edge of the trailer third length thin surface unit. Note that the fifth pattern as shown in FIG. 8 may be based on the same repeating unit as the first pattern of FIG. 2.

To create another basic first pattern from thin surface units having at least n different lengths, the plurality of predimensioned rectangular thin surface units of the apparatus of each the non-uniform grout width surface system and the uniform grout width surface system that involve n lengths of thin surface units may be relatively arranged in at least one repeatable installed thin surface unit pattern that may comprise two center leader first length thin surface units that each abut one another along inner length edges to substantially form a square; two trailer first length thin surface units each having one inner length edge that abuts a width edge of each of the two center leader first length thin surface units; two leader second length thin surface units each having one inner length edge that abuts a width edge of each of the two trailer first length thin surface units and an outer length edge of one of the two center leader first length thin surface units; two trailer second length thin surface units that each having one inner length edge that abuts a width edge of each the leader second length thin surface unit and an outer length edge of one of the two trailer first length thin surface units; two leader third length thin surface units that each have one inner length edge that abuts a width edge of each of the two second length trailer thin surface units and an outer length edge of one of the two leader second length thin surface units; two trailer third length thin surface units that each have one inner length edge that abuts a width edge of each leader third length thin surface unit and an outer length edge of the trailer second length thin surface unit; two leader $n^{th}$ length thin surface units each having one inner length edge that abuts a width edge of each of the two $(n-1)^{th}$ length trailer thin surface units and an outer length edge of one of the two leader $(n-1)^{th}$ length thin surface units. This apparatus may further comprise two trailer $n^{th}$ length thin surface units each having one inner length edge that abuts a width edge of each leader $n^{th}$ length thin surface unit and an outer length edge of the trailer $(n-1)^{th}$ length thin surface unit. The term $(n-1)^{th}$ length thin surface unit would, for example, refer to the fourth length thin surface unit if n were five.

A surface constructed using any of the above apparatus is also contemplated as an aspect of the invention. As used herein, the term center leader first length thin surface units refers to those first length thin surface units that effectively form the apparent center of the repeating (or repeatable) unit of the first design. They are termed leader because a setter (i.e., a person who sets or fixedly establishes the thin surface units) would likely initiate the setting of the thin surface units according to this pattern by first setting these two center pieces. The trailer first length thin surface units would then be set in relation to the already set center leader first length thin surface units. Each length of thin surface unit would first be set using what are termed the leader thin surface unit for that length (the leader second length if the thin surface units are second length thin surface units); thin surface units that are set parallel to the center leader units are termed leader and would likely be set first because the outer length edges of the trailer thin surface units of the immediately lower length provide definitive guides by which to accurately set the leader thin surface units (by aligning their width edges). The trailer thin surface units can then be accurately set by aligning trailer surface unit width edges with the outer length edges of the leader thin surface units of the same length. Outer length edges refer to the edges along the length of the thin surface units that, upon setting, are furthest in distance from the center leader thin surface units. Inner length edges refer to the edges along the length of the thin surface units that, upon setting, are closest in distance to the center leader thin surface units.

To create a basic second pattern from thin surface units having at least three different lengths, the plurality of predimensioned rectangular thin surface units of the apparatus of each the non-uniform grout width surface system and the uniform grout width surface system that involve three lengths of thin surface units may be relatively arranged in at least one repeatable installed thin surface unit pattern that may comprise two first direction aligned first length thin surface units that abut along inner length edges to substantially form a first square; a substantially square orthogonal second direction aligned double first length thin surface unit pair that has a length edge that abuts a width edge of each of the two first direction aligned first length thin surface units; two single second length thin surface units that each have a length edge that abuts an outer length edge of one of the first direction aligned first length thin surface units and a width edge of the substantially square orthogonal second direction aligned double first length thin surface unit pair; a rectangular double second length thin surface unit pair that has a length edge that abuts a width edge of each of the two single second length thin surface units and a length edge of the substantially square orthogonal second direction aligned double first length thin surface unit pair; two single third length thin surface units that each have a length edge that abuts an outer length edge of one of the single second length thin surface units and a width edge of the rectangular double second length thin surface unit pair; and a rectangular double third length thin surface unit pair that has a length edge that abuts a width edge of each of the two single third length thin surface units and a length edge of the rectangular double second length thin surface unit pair.

Figure 3:
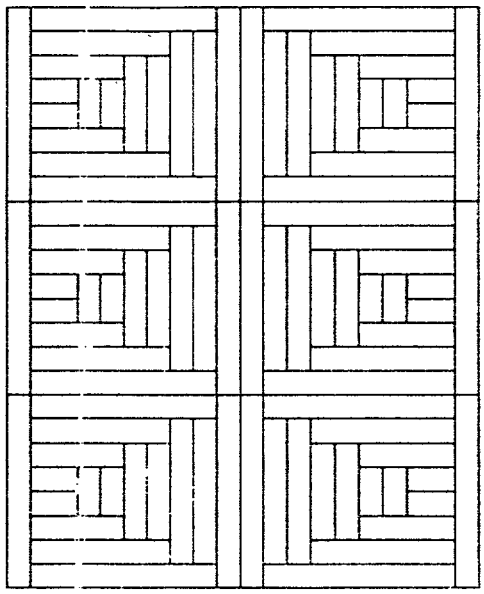
FIG. 3 shows design pattern #2.

The orthogonal second direction aligned thin surface units have a longitudinal axis (the axis along the length) that may be perpendicular to first direction aligned thin surface units (the first direction aligned thin surface units have a longitudinal axis aligned in a first direction). Single second length (e.g.) thin surface units (as opposed to a double second length thin surface unit pair) refer to the second length thin surface units that, instead of being installed adjacent one another, may be separated by other thin surface units; a double second length thin surface unit pair, e.g., is two second length thin surface units that may be installed adjacent one another in a parallel fashion so as to substantially form a rectangular shape. Note that the single thin surface units may be first direction aligned while double thin surface units may be orthogonal second direction aligned. Length edge refers to either of two edges along the length of a thin surface unit; width edge refers to either of two edges along the width of a thin surface unit. FIG. 3 is useful to illustrate not only a four length second pattern system, but also second patterns made from fewer or more lengths.

To create another basic second pattern from thin surface units having at least four different lengths (see FIG. 3), the plurality of predimensioned rectangular thin surface units of the apparatus of each the non-uniform grout width surface system and the uniform grout width surface system that involve four lengths of thin surface units may be relatively arranged in at least one repeatable installed thin surface unit pattern that may comprise (in addition to the elements of the three-length second pattern) two single fourth length thin stone surface units that each have a length edge that abuts an outer length edge of one of the single third length thin stone surface units and a width edge of the rectangular double third length thin stone surface unit pair; and a rectangular double fourth length thin stone surface unit pair that has a length edge that abuts a width edge of each of the two single fourth length thin stone surface units and a length edge of the rectangular double third length thin stone surface unit pair.

To create another basic second pattern (according to an original design) from thin surface units having at least n different lengths, the plurality of predimensioned rectangular thin surface units of the apparatus of each the non-uniform grout width surface system and the uniform grout width surface system that involve n lengths of thin surface units may be relatively arranged in at least one repeatable installed thin surface unit pattern that may comprise two first direction aligned first length thin surface units that abut along inner length edges to substantially form a first square; a substantially square orthogonal second direction aligned double first length thin surface unit pair that has a length edge that abuts a width edge of each of the two first direction aligned first length thin surface units; two single second length thin surface units that each have a length edge that abuts an outer length edge of one of the first direction aligned first length thin surface units and a width edge of the substantially square orthogonal second direction aligned double first length thin surface unit pair; a rectangular double second length thin surface unit pair that has a length edge that abuts a width edge of each of the two single second length thin surface units and a length edge of the substantially square orthogonal second direction aligned double first length thin surface unit pair; two single third length thin surface units that each have a length edge that abuts an outer length edge of one of the single second length thin surface units and a width edge of the rectangular double second length thin surface unit pair; a rectangular double third length thin surface unit pair that has a length edge that abuts a width edge of each of the two single third length thin surface units and a length edge of the rectangular double second length thin surface unit pair; and so on, to and including two single $n^{th}$ length thin surface units that each have a length edge that abuts an outer length edge of one of the single $(n-1)^{th}$ length thin surface units and a width edge of the rectangular double $(n-1)^{th}$ length thin surface unit pair; a rectangular double $n^{th}$ length thin surface unit pair that has a length edge that abuts a width edge of each of the two single $n^{th}$ length thin surface units and a length edge of the rectangular double $(n-1)^{th}$ length thin surface unit pair.

Each of the above repeatable installed thin surface unit patterns may be repeated (either inversely or in a standard manner) in a first direction and repeated (in the standard manner) in a second direction. In the second pattern claims, the term first direction refers to that direction with which the single thin surface units may be longitudinally aligned. Inversely repeating in this first direction refers to a "hinged, swinging-door" type repetition instead of a standard type repetition that would more commonly be observed in a second direction (but that also may be observed in first direction instead of, or in addition to, the inverse repetition; see FIG. 3). The second direction refers to the direction with which the double thin surface units may be longitudinally aligned. An installed surface constructed according to any of the above-mentioned patterns is also considered part of the invention. It is important to note that in this second pattern (or in any of the patterns addressed in this application, whenever two first length thin surface units abut along length edges to substantially form a square, the resultant pattern that incorporates these two thin surface units may also be modified such that these two thin surface units are replaced by a single substantially square thin surface unit.

Figure 4:
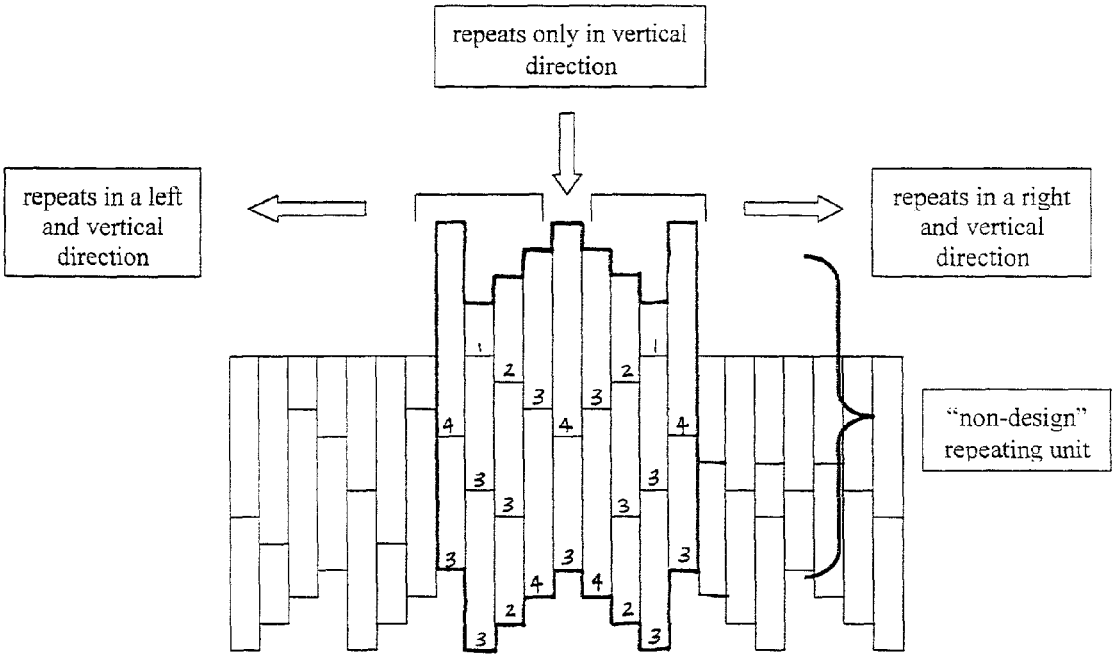
FIG. 4 shows non-design (or modified design) pattern #3.
Figure 5:
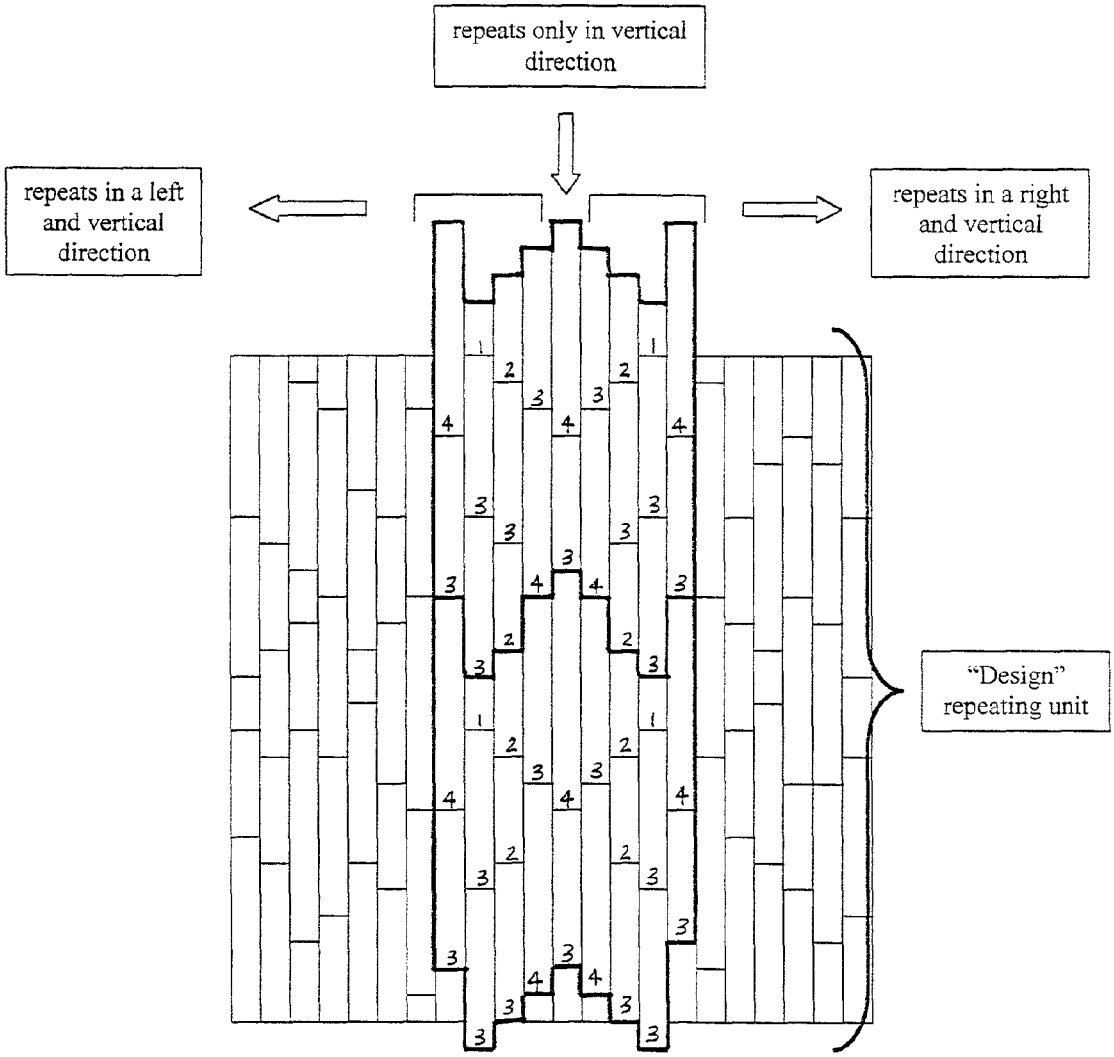
FIG. 5 shows design pattern #3.
Figure 6:
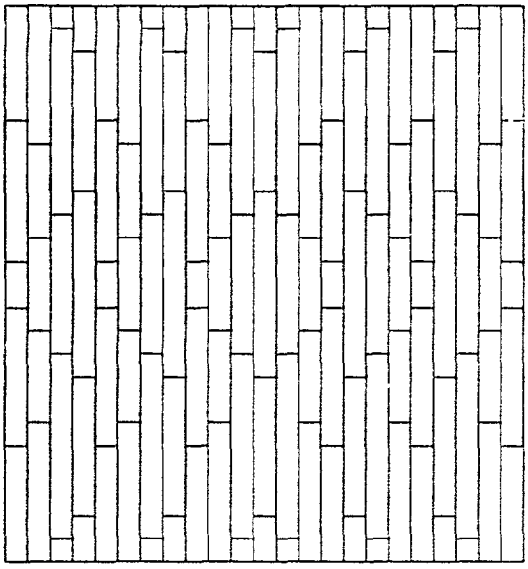
FIG. 6 shows design pattern #3.
Figure 7:
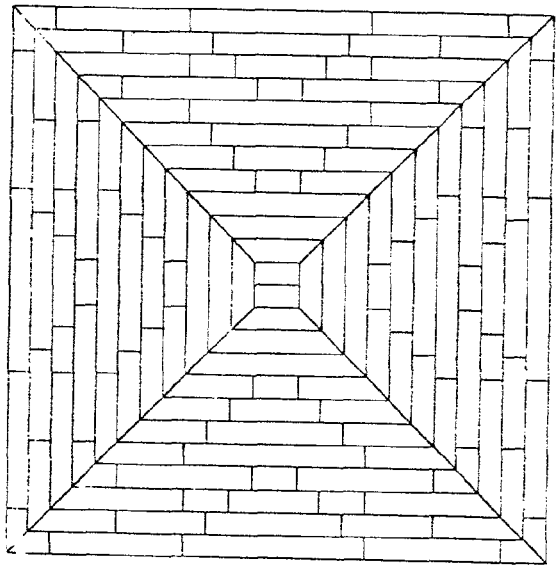
FIG. 7 shows design pattern #4

To create at least one repeatable installed thin surface unit pattern according to a modified third pattern design (see FIG. 4) from thin surface units having at least four different lengths, the plurality of predimensioned rectangular thin surface units of the apparatus of each the non-uniform grout width surface system and the uniform grout width surface system that involve four lengths of thin surface units may be relatively arranged in at least one repeatable installed thin surface unit pattern that may comprise a first thin surface unit column, a second thin surface unit column, a third thin surface unit column, a fourth thin surface unit column, a fifth thin surface unit column, a sixth thin surface unit column, a seventh thin surface unit column, an eighth thin surface unit column and a ninth thin surface unit column wherein the first thin surface unit column may comprise a lower third length thin surface unit whose upper width edge abuts a lower width edge of a fourth length thin surface unit; wherein the second thin surface unit column may comprise a lower third length thin surface unit whose upper width edge abuts a lower width edge of a third length thin surface unit whose upper width edge abuts a lower width edge of a first length thin surface unit; wherein the third thin surface unit column may comprise a lower second length thin surface unit whose upper width edge abuts a lower width edge of a third length thin surface unit whose upper width edge abuts a lower width edge of a second length thin surface unit; wherein the fourth thin surface unit column may comprise a lower fourth length thin surface unit whose upper width edge abuts a lower width edge of a third length thin surface unit; wherein the fifth thin surface unit column may comprise a lower third length thin surface unit whose upper width edge abuts a lower width edge of a fourth length thin surface unit; wherein the sixth thin surface unit column may comprise a lower fourth length thin surface unit whose upper width edge abuts a lower width edge of a third length thin surface unit wherein the seventh thin surface unit column may comprise a lower second length thin surface unit whose upper width edge abuts a lower width edge of a third length thin surface unit whose upper width edge abuts a lower width edge of a second length thin surface unit wherein the eighth thin surface unit column may comprise a lower third length thin surface unit whose upper width edge abuts a lower width edge of a third length thin surface unit whose upper width edge abuts a lower width edge of a first length thin surface unit; wherein the ninth thin surface unit column may comprise a lower third length thin surface unit whose upper width edge abuts a lower width edge of a fourth length thin surface unit; wherein a right length edge of the first thin surface unit column abuts a left length edge of the second thin surface unit column, a right length edge of the second thin surface unit column abuts a left length edge of the third thin surface unit column, a right length edge of the third thin surface unit column abuts a left length edge of the fourth thin surface unit column, a right length edge of the fourth thin surface unit column abuts a left length edge of the fifth thin surface unit column, a right length edge of the fifth thin surface unit column abuts a left length edge of the sixth thin surface unit column, a right length edge of the sixth thin surface unit column abuts a left length edge of the seventh thin surface unit column, a right length edge of the seventh thin surface unit column abuts a left length edge of the eighth thin surface unit column, and a right length edge of the eighth thin surface unit column abuts a left length edge of the ninth thin surface unit column; wherein a lower width edge of the third length thin surface unit of the first thin surface unit column may be substantially one and one-half times a first length thin surface unit length higher than a lower width edge of the lower third length thin surface unit of the second thin surface unit column wherein a lower width edge of the lower third length thin surface unit of the second thin surface unit column may be substantially one-half times a first length thin surface unit length lower than a lower width edge of the lower second length thin surface unit of the third thin surface unit column wherein a lower width edge of the lower second length thin surface unit of the third thin surface unit column may be substantially one-half times a first length thin surface unit length lower than a lower width edge of the fourth length thin surface unit of the fourth thin surface unit column wherein a lower width edge of the fourth length thin surface unit of the fourth thin surface unit column may be substantially one-half times a first length thin surface unit length lower than a lower width edge of the third length thin surface unit of the fifth thin surface unit column wherein a lower width edge of the third length thin surface unit of the fifth thin surface unit column may be substantially one-half times a first length thin surface unit length higher than a lower width edge of the fourth length thin surface unit of the sixth thin surface unit column wherein a lower width edge of the fourth length thin surface unit of the sixth thin surface unit column may be substantially one-half times a first length thin surface unit length higher than a lower width edge of the lower second length thin surface unit of the seventh thin surface unit column wherein a lower width edge of the lower second length thin surface unit of the seventh thin surface unit column may be substantially one-half times a first length thin surface unit length higher than a lower width edge of the lower third length thin surface unit of the eighth thin surface unit column wherein a lower width edge of the lower third length thin surface unit of the eighth thin surface unit column may be substantially one and one-half times a first length thin surface unit length lower than a lower width edge of the third length thin surface unit of the ninth thin surface unit column and wherein the first thin surface unit column, the second thin surface unit column, the third thin surface unit column and the fourth thin surface unit column may be repeatable in each a left, upward and downward direction, the sixth thin surface unit column, the seventh thin surface unit column, the eighth thin surface unit column and the ninth thin surface unit column may be repeatable in each a right, upward and downward direction, and the fifth thin surface unit column may be repeatable in a upward and downward direction. It is important to note that the terms right, left, lower and upper are defined with respect to the pattern as it may be oriented in front of a hypothetical viewer of the installed pattern in the manner shown in the figures, with upper referring to a forward direction and lower referring to a behind or backward direction relative to this viewer. Expressed another way, what is important is the directions indicated by the terms left, right, lower and upper as relative to one another, and not whether they precisely match or coincide with directions that might otherwise be accorded the thin surface units with respect to the setting in which they may be laid, or the relative orientation of an individual viewing the installed surface. Note that for purposes of simplicity, the term "non-design repeating unit" is included in FIG. 4 to indicate the repeating unit, although (as also indicated in the figure), some portions of the repeating unit repeat (the center column, column 5) may repeat in one direction only (up/down, or vertically) and the remaining portions of the "non-design repeating unit" may be repeatable both in a vertical direction and in a left or right direction. In FIG. 4, as well as in FIG. 5, numbers may be used to indicate that a surface unit is a first, second, or etc. length surface unit.

The original (as opposed to modified) design, however, may involve a repeatable installed thin surface unit pattern that may be approximately twice the size of that repeatable unit pattern described above in the modified design pattern (see FIGS. 5 and 6). The additional thin surface units used to form the entire repeatable unit of the original design pattern are termed additional thin surface units, and may be specified as, for example, an upper additional second column third length thin surface unit. The term upper orients the thin surface unit in an installed position relative to a lower thin surface unit piece of the same column; the term additional indicates that this thin surface unit is a part of that set of thin surface units that may be added to the repeatable installed thin surface unit pattern of the modified design pattern described above in order to create the repeatable installed thin surface unit pattern of the original design. In order to create this larger repeatable pattern of the original design, the first thin surface unit column may further comprise an additional first column fourth length thin surface unit whose upper width edge abuts a lower width edge of the lower third length thin surface unit of the first thin surface unit column; and an additional first column third length thin surface unit whose upper width edge abuts a lower width edge of the additional first column fourth length thin surface unit; the second thin surface unit column may further comprise: a lower additional second column third length thin surface unit; an upper additional second column third length thin surface unit having a lower width edge that abuts an upper width edge of the lower additional second column third length thin surface unit; and an additional second column first length thin surface unit having a lower width edge that abuts an upper width edge of the upper additional second column third length thin surface unit and having an upper width edge that abuts a lower width edge of the lower third length thin surface unit of the second column; the third thin surface unit column may further comprise: a additional third column third length thin surface unit; a lower additional third column second length thin surface unit having a lower width edge that abuts an upper width edge of the lower additional third column third length thin surface unit; and an upper additional third column second length thin surface unit having a lower width edge that abuts an upper width edge of the lower additional third column second length thin surface unit and having an upper width edge that abuts a lower width edge of the lower second length thin surface unit of the third column; the fourth thin surface unit column may further comprise: an additional fourth column third length thin surface unit whose upper width edge abuts a lower width edge of the lower fourth length thin surface unit of the fourth thin surface unit column; an additional fourth column fourth length thin surface unit whose upper width edge abuts a lower width edge of the additional fourth column third length thin surface unit; and the fifth thin surface unit column may further comprise an additional fifth column fourth length thin surface unit whose upper width edge abuts a lower width edge of the lower third length thin surface unit of the fifth thin surface unit column; and an additional fifth column third length thin surface unit whose upper width edge abuts a lower width edge of the additional fifth column fourth length thin surface unit; wherein the sixth thin surface unit column may further comprise: an additional sixth column third length thin surface unit whose upper width edge abuts a lower width edge of the lower fourth length thin surface unit of the sixth thin surface unit column; and an additional sixth column fourth length thin surface unit whose upper width edge abuts a lower width edge of the additional sixth column third length thin surface unit; the seventh thin surface unit column may further comprise a additional seventh column third length thin surface unit; a lower additional seventh column second length thin surface unit having a lower width edge that abuts an upper width edge of the lower additional seventh column third length thin surface unit; and an upper additional seventh column second length thin surface unit having a lower width edge that abuts an upper width edge of the lower additional seventh column second length thin surface unit and having an upper width edge that abuts a lower width edge of the lower second length thin surface unit of the seventh column; the eighth thin surface unit column may further comprise: a lower additional eighth column third length thin surface unit; an upper additional eighth column third length thin surface unit having a lower width edge that abuts an upper width edge of the lower additional eighth column third length thin surface unit; and an additional eighth column first length thin surface unit having a lower width edge that abuts an upper width edge of the upper additional eighth column third length thin surface unit and having an upper width edge that abuts a lower width edge of the lower third length thin surface unit of the eighth column; and the ninth thin surface unit column may further comprise: an additional ninth column fourth length thin surface unit whose upper width edge abuts a lower width edge of the lower third length thin surface unit of the ninth thin surface unit column; and an additional ninth column third length thin surface unit whose upper width edge abuts a lower width edge of the additional ninth column fourth length thin surface unit. Note that for purposes of simplicity, the term "design repeating unit" is included in FIG. 5 to indicate the repeating unit, although (as also indicated in the figure), some portions of the repeating unit repeat (the center column, column 5) may repeat in one direction only (up/down, or vertically) and the remaining portions of the "design repeating unit" may be repeatable both in a vertical direction and in a left or right direction. An installed surface constructed according to the pattern described in any of the above third pattern designs is also considered part of the invention. Patterns similar to the modified and original design third pattern but using surface units having fewer or more than four different lengths are also contemplated as part of the invention.

To create a basic fourth pattern (see FIG. 7) from thin surface units having at least four different lengths, the plurality of predimensioned rectangular thin surface units of the apparatus of each the non-uniform grout width surface system and the uniform grout width surface system that involve four lengths of thin surface units may be relatively arranged in a central installed thin surface unit core set and four directionally repeating installed thin surface unit sets wherein the central installed thin surface unit core set may comprise: at least one center leader surface square and a first border surface section that may comprise: a left first double diagonal cut thin surface unit that has an inner length of substantially a first length thin surface unit length and that has an inner length edge that abuts a left edge of the center leader surface square; an upward first double diagonal cut thin surface unit that has an inner length of substantially a first length thin surface unit length and that has an inner length edge that abuts an upward edge of the center leader surface square; a downwards first double diagonal cut thin surface unit that has an inner length of substantially a first length thin surface unit length and that has an inner length edge that abuts a downwards edge of the center leader surface square; and an right first double diagonal cut thin surface unit that has an inner length of substantially a first length thin surface unit length and that has an inner length edge that abuts a right edge of the center leader surface square; a second border surface section that may comprise: a left second double diagonal cut thin surface unit that has an inner length of substantially a second length thin surface unit length and that has a inner length edge that abuts an outer length edge of the left first double diagonal cut thin surface unit; a upward second double diagonal cut thin surface unit that has an inner length of substantially a second length thin surface unit length and that has a inner length edge that abuts an outer length edge of the upward first double diagonal cut thin surface unit; a downward second double diagonal cut thin surface unit that has an inner length of substantially a second length thin surface unit length and that has a inner length edge that abuts an outer length edge of the downward first double diagonal cut thin surface unit; and a right second double diagonal cut thin surface unit that has an inner length of substantially a second length thin surface unit length and that has a inner length edge that abuts an outer length edge of the right first double diagonal cut thin surface unit; and a third border surface section that may comprise: a left third double diagonal cut thin surface unit that has an inner length of substantially a third length thin surface unit length and that has a inner length edge that abuts an outer length edge of the left second double diagonal cut thin surface unit; a upward third double diagonal cut thin surface unit that has an inner length of substantially a third length thin surface unit length and that has a inner length edge that abuts an outer length edge of the upward second double diagonal cut thin surface unit; a downward third double diagonal cut thin surface unit that has an inner length of substantially a third length thin surface unit length and that has a inner length edge that abuts an outer length edge of the downward second double diagonal cut thin surface unit; and a right third double diagonal cut thin surface unit that has an inner length of substantially a third length thin surface unit length and that has a inner length edge that abuts an outer length edge of the right second double diagonal cut thin surface unit; wherein the four directionally repeating installed thin surface unit sets may comprise: a fourth border surface section that may comprise: a left fourth border surface section that may comprise two left fourth border single diagonal cut thin surface units each having an outer length of substantially a second length thin surface unit length; and a left, fourth border first length thin surface unit disposed between the two fourth border single diagonal cut thin surface units so that each width edge of the left fourth border first length thin surface unit abuts a width edge of one of the left fourth border single diagonal cut thin surface units; a upward fourth border surface section that may comprise two upward fourth border single diagonal cut thin surface units each having an outer length of substantially a second length thin surface unit length; and an upward fourth border first length thin surface unit disposed between the two fourth border single diagonal cut thin surface units so that each width edge of the upward fourth border first length thin surface unit abuts a width edge of one of the upward fourth border single diagonal cut thin surface units; a right fourth border surface section that may comprise two right fourth border single diagonal cut thin surface units each having an outer length of substantially a second length thin surface unit length; and a right, fourth border, first length thin surface unit disposed between the two single diagonal cut thin surface units so that each width edge of the right fourth border first length thin surface unit abuts a width edge of one of the right fourth border single diagonal cut thin surface units; and a downwards fourth border surface section that may comprise two downwards fourth border single diagonal cut thin surface units each having an outer length of substantially a second length thin surface unit length; and a downwards, fourth border first length thin surface unit disposed between the two single diagonal cut thin surface units so that each width edge of the downward fourth border first length thin surface unit abuts a width edge of one of the downwards fourth border single diagonal cut thin surface units; a fifth border surface section that may comprise: a left fifth border surface section that may comprise two left fifth border single diagonal cut thin surface units each having an outer length of substantially a second length thin surface unit length; and a left fifth border second length thin surface unit disposed between the two single diagonal cut thin surface units so that each width edge of the left fifth border second length thin surface unit abuts a width edge of one of the left fifth border single diagonal cut thin surface units; a upward fifth border surface section that may comprise two upward fifth border single diagonal cut thin surface units each having an outer length of substantially a second length thin surface unit length; and an upward fifth border second length thin surface unit disposed between the two single diagonal cut thin surface units so that each width edge of the upward fifth border second length thin surface unit abuts a width edge of one of the upward fifth border single diagonal cut thin surface units; a downwards fifth border surface section that may comprise two downwards fifth border single diagonal cut thin surface units each having an outer length of substantially a second length thin surface unit length; and a downward fifth border second length thin surface unit disposed between the two single diagonal cut thin surface units so that each width edge of the downward fifth border second length thin surface unit abuts a width edge of one of the downwards fifth border single diagonal cut thin surface units; and a right fifth border surface section that may comprise two right fifth border single diagonal cut thin surface units each having an outer length of substantially a second length thin surface unit length; and a right fifth border second length thin surface unit disposed between the two single diagonal cut thin surface units so that each width edge of the right fifth border second length thin surface unit abuts a width edge of one of the right fifth border single diagonal cut thin surface units; a sixth border surface section that may comprise: a left sixth border surface section that may comprise two left sixth border single diagonal cut thin surface units each having an outer length of substantially a second length thin surface unit length; and a left sixth border third length thin surface unit disposed between the two single diagonal cut thin surface units so that each width edge of the left sixth border third length thin surface unit abuts a width edge of one of the left sixth border single diagonal cut thin surface units; a upward sixth border surface section that may comprise two upward sixth border single diagonal cut thin surface units each having an outer length of substantially a second length thin surface unit length; and an upward sixth border third length thin surface unit disposed between the two single diagonal cut thin surface units so that each width edge of the upward sixth border third length thin surface unit abuts a width edge of one of the upward sixth border single diagonal cut thin surface units; a downward sixth border surface section that may comprise two downwards sixth border single diagonal cut thin surface units each having an outer length of substantially a second length thin surface unit length; and a downward sixth border third length thin surface unit disposed between the two single diagonal cut thin surface units so that each width edge of the downward sixth border third length thin surface unit abuts a width edge of one of the downward sixth border single diagonal cut thin surface units; and a right sixth border surface section that may comprise two right sixth border single diagonal cut thin surface units each having an outer length of substantially a second length thin surface unit length; and a right sixth border third length thin surface unit disposed between the two single diagonal cut thin surface units so that each width edge of the right sixth border fourth length thin surface unit abuts a width edge of one of the right sixth border single diagonal cut thin surface units; and a seventh border surface section that may comprise: a left seventh border surface section that may comprise: two left seventh border single diagonal cut thin surface units each having an outer length of substantially a second length thin surface unit length; and a left seventh border fourth length thin surface unit disposed between the two single diagonal cut thin surface units so that each width edge of the left seventh border fourth length thin surface unit abuts a width edge of one of the left seventh border single diagonal cut thin surface units; an upward seventh border surface section that may comprise two upward seventh border single diagonal cut thin surface units each having an outer length of substantially a second length thin surface unit length; and an upward seventh border fourth length thin surface unit disposed between the two single diagonal cut thin surface units so that each width edge of the upward seventh border fourth length thin surface unit abuts a width edge of one of the upward seventh border single diagonal cut thin surface units; a downward seventh border surface section that may comprise two downward seventh border single diagonal cut thin surface units each having an outer length of substantially a second length thin surface unit length; and a downward seventh border fourth length thin surface unit disposed between the two single diagonal cut thin surface units so that each width edge of the downward seventh border fourth length thin surface unit abuts a width edge of one of the downward seventh border single diagonal cut thin surface units; and a right seventh border surface section that may comprise two right seventh border single diagonal cut thin surface units each having an outer length of substantially a second length thin surface unit length; and a right seventh border fourth length thin surface unit disposed between the two single diagonal cut thin surface units so that each width edge of the right seventh border fourth length thin surface unit abuts a width edge of one of the right seventh border single diagonal cut thin surface units; wherein an inner edge of the first border surface section abuts an outer edge of the at least one center leader surface square; an inner edge of the second border surface section abuts an outer edge of the first border surface section; an inner edge of the third border surface section abuts an outer edge of the second border surface section; an inner edge of the fourth border surface section abuts an outer edge of the third border surface section; an inner edge of the fifth border surface section abuts an outer edge of the fourth border surface section; an inner edge of the sixth border surface section abuts an outer edge of the fifth border surface section; and an inner edge of the seventh border surface section abuts an outer edge of the sixth border surface section; wherein the left fourth border surface section, the left fifth border surface section, the left sixth border surface section, and the left seventh border surface section may be each repeatable in a left direction; wherein upward fourth border surface section, the upward fifth border surface section, the upward sixth border surface section, and the upward seventh border surface section each may be repeatable in an upward direction; wherein the right fourth border surface section, the right fifth border surface section, the right sixth border surface section, and the right seventh border surface section may each be repeatable in a right direction; and wherein the downward fourth border surface section, the downward fifth border surface section, the downward sixth border surface section, and the downward seventh border surface section may be each repeatable in a downward direction. A similar pattern that involves fewer or more than four lengths is also contemplated as part of the invention. An installed surface constructed using any of the above apparatus of this pattern is also considered part of the invention.

In the above design apparatus, the central installed thin surface unit core set may be that arrangement of thin surface units that, aside from the center leader surface square, has each border surface section made from one thin surface unit. The center leader surface square forms the center of the repeating unit and may be the first thin surface unit(s) laid by the setter (and therefore may be called the leader surface square). It may be a square thin surface unit or it may be made from two first length thin surface units to substantially form a square. There may be three border surface sections as part of the central installed thin surface unit core set that are external to the center leader surface square, with each having a left, right, upward and downward double diagonal cut thin surface unit (the diagonal cut may be at forty-five degrees). The term double diagonal cut means that each direction's thin surface unit in the first three border sections has two diagonal cuts that create cut faces that may be perpendicular to one another. Each of the cut faces abuts a cut face of a same border thin surface unit of a different direction (as shown in the figure, the left double diagonal cut thin surface unit of any border section abuts the upper and lower double diagonal cut thin surface units of the same border section while the right double diagonal cut thin surface unit of any border section abuts the upper and lower double diagonal cut thin surface units of the same border section). The fourth, fifth, sixth and seventh border sections may comprise more than one thin surface unit, perhaps do not comprise any double diagonal cut thin surface units, and may comprise thin surface units that are single diagonal cut. These border sections form the four directionally repeating installed thin surface unit sets. As shown in the figure, a single direction of the fourth border section may comprise a first length thin surface unit and two single diagonal cut thin surface units, a single direction of the fifth border section may comprise a second length thin surface unit and two single diagonal cut thin surface units, a single direction of the sixth border section may comprise a third length thin surface unit and two single diagonal cut thin surface units, and a single direction of the seventh border section may comprise a fourth length thin surface unit and two single diagonal cut thin surface units. Each of the fourth, fifth, sixth and seventh border sections of a given direction may repeat in the respective direction, creating the pattern as shown in the figure with two mutually orthogonal diagonal grout lines.

To create a basic sixth pattern from thin surface units having at least four different lengths, the plurality of predimensioned rectangular thin surface units of the apparatus of each the non-uniform grout width surface system and the uniform grout width surface system that involve four lengths of thin surface units may be relatively arranged in at least one repeatable installed thin surface unit pattern that may comprise: a first thin surface unit layer that may comprise a first layer fourth length thin surface unit having a right width edge that abuts a left width edge of a first layer first length thin surface unit; a second thin surface unit layer that may comprise a second layer third length thin surface unit having a right width edge that abuts a left width edge of a second layer second length thin surface unit, wherein a lower length edge of the second thin surface unit layer abuts an upper length edge of the first thin surface unit layer; and a third thin surface unit layer that may comprise a third layer second length thin surface unit having a right width edge that abuts a left width edge of a third layer third length thin surface unit, wherein a lower length edge of the third thin surface unit layer abuts an upper length edge of the second thin surface unit layer; wherein a right width edge of the first layer first length thin surface unit may be substantially one-half a first length thin surface unit length left of a right width edge of the second layer second length thin surface unit; and wherein a right width edge of the second layer second length thin surface unit may be substantially one-half a first length thin surface unit length left of a right width edge of the third layer third length thin surface unit. The preceding apparatus may further comprise a fourth thin surface unit layer that may comprise a fourth layer first length thin surface unit having a right width edge that abuts a left width edge of a fourth layer fourth length thin surface unit, wherein a lower length edge of the fourth thin surface unit layer abuts an upper length edge of the third thin surface unit layer; wherein a right width edge of the third layer third length thin surface unit may be substantially one-half a first length thin surface unit length left of a right width edge of the fourth layer fourth length thin surface unit. An installed surface constructed according to any of the above sixth pattern apparatus is also considered part of the invention. A method of constructing a building surface that may comprise configuring elements as set forth in any of the above apparatus of patterns one through six is considered part of the invention also. Other patterns that are considered as embodiments of the invention may be as shown in FIGS. 10 and 12-17. Further, packages, such as crates or containers, including their contents are considered as part of this invention.

As can be easily understood from the foregoing, the basic concepts of the present invention may be embodied in a variety of ways. It involves both surfacing and packaging techniques as well as devices to accomplish the appropriate surfacing and packaging. In this application, the surfacing and packaging techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this provisional application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims which will be included in a full patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon in this non-provisional patent application. It should be understood that such language changes and broad claiming is herein accomplished by the applicant. The non-provisional patent application seeks examination of as broad a base of claims as deemed within the applicant's right and is designed to yield a patent covering numerous aspects of the invention both independently and as an overall system.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "surface" should be understood to encompass disclosure of the act of "surfacing"—whether explicitly discussed or not—and, conversely, were there effectively disclosure of the act of "surfacing", such a disclosure should be understood to encompass disclosure of a "surface" and even a "means for surfacing" Such changes and alternative terms are to be understood to be explicitly included in the description.

Any acts of law, statutes, regulations, or rules mentioned in this application for patent; or patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Patent Application or other information statement or Exhibits or Examples filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to claim at least: i) each of the surface systems as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, and ix) methods and apparatuses substantially as described hereinbefore and with reference to any of the accompanying examples, x) the various combinations and permutations of each of the elements disclosed, and xi) each potentially dependent claim or concept as a dependency on each and every one of the independent claims or concepts presented. In this regard it should be understood that for practical reasons and so as to avoid adding potentially hundreds of claims, the applicant may eventually present claims with initial dependencies only. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

The claims set forth in this specification by are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A relational stone, building surface system comprising:

a. a plurality of discrete predimensioned rectangular first length thin quarried material surface units having a unit width and having a first length, wherein a total of said unit width plus a non-negligible, longitudinally adjacent thin quarried material surface unit design separation width is substantially equal to one-half said first length;

b. a plurality of discrete predimensioned rectangular second length thin quarried material surface units substantially having said unit width and having a second length, wherein a total of said unit width plus said non-negligible, longitudinally adjacent thin quarried material surface unit design separation width is substantially equal to one-fourth said second length;

c. a plurality of discrete predimensioned rectangular third length thin quarried material surface units substantially having said unit width and having a third length, wherein a total of said unit width plus said non-negligible, longitudinally adjacent thin quarried material surface unit design separation width is substantially equal to said one sixth said third length; and d. a plurality of discrete predimensioned rectangular fourth length thin quarried material surface units substantially having said unit width and having a fourth length, wherein a total of said unit width plus said non-negligible, longitudinally adjacent thin quarried material surface unit design separation width is substantially equal to one-eighth said fourth length, wherein a number of each installed discrete predimensioned rectangular first length thin quarried material surface units, installed discrete predimensioned rectangular second length thin quarried material surface units, installed discrete predimensioned rectangular third length thin quarried material surface units and installed discrete predimensioned rectangular fourth length thin quarried material surface units is approximately twenty-five percent the total number of installed discrete predimensioned rectangular thin quarried material surface units.

2. A relational stone, building surface system as described in claim 1 wherein said first length is approximately equal to twelve inches.

3. A relational stone, building surface system as described in claim 2 wherein said unit width is approximately five and seven-eighths inches.

4. A relational stone, building surface system as described in claim 3 wherein said non-negligible, longitudinally adjacent thin quarried material surface unit design separation width is approximately equal to one-eighth inch.

5. A relational stone, building surface system as described in claim 4 further comprising a plurality of predimensioned square thin quarried material surface units.

6. A relational stone, building surface made using a relational surface system as described in claim 1.

7. A relational stone, building surface system as described in claim 1 wherein said plurality of discrete predimensioned rectangular thin quarried material surface units are relatively arranged in at least one repeatable installed thin quarried material surface unit pattern comprising:

a. two center leader first length thin quarried material surface units that each abut one another along inner length edges to substantially form a square;

b. two trailer first length thin quarried material surface units each having one inner length edge that abuts a width edge of each of said two center leader first length thin quarried material surface units;

c. two leader second length thin quarried material surface units each having one inner length edge that abuts a width edge of each of said two trailer first length thin quarried material surface units and an outer length edge of one of said two center leader first length thin quarried material surface units;

d. two trailer second length thin quarried material surface units that each have one inner length edge that abuts a width edge of each said leader second length thin quarried material surface unit and an outer length edge of one of said two trailer first length thin quarried material surface units;

e. two leader third length thin quarried material surface units that each have one inner length edge that abuts a width edge of each of said two second length trailer thin quarried material surface units and an outer length edge of one of said two leader second length thin quarried material surface units;

f. two trailer third length thin quarried material surface units that each have one inner length edge that abuts a width edge of each leader third length thin quarried material surface unit and an outer length edge of said trailer second length thin quarried material surface unit;

g. two leader fourth length thin quarried material surface units each having one inner length edge that abuts a width edge of each of said two third length trailer thin quarried material surface units and an outer length edge of one of said two leader third length thin quarried material surface units; and h. two trailer fourth length thin quarried material surface units each having one inner length edge that abuts a width edge of each leader fourth length thin quarried material surface unit and an outer length edge of said trailer third length thin quarried material surface unit.

8. A relational stone, building surface system creating a quarried material surface constructed according to the pattern set forth in claim 7.

9. A relational stone, building surface system as described in claim 1 wherein said plurality of discrete predimensioned rectangular thin quarried material surface units are relatively arranged in at least one repeatable installed thin quarried material surface unit pattern that comprises:

a. two first direction aligned first length thin quarried material surface units that abut along inner length edges to substantially form a first square;

b. a substantially square orthogonal second direction aligned double first length thin quarried material surface unit pair that has a length edge that abuts a width edge of each of said two first direction aligned first length thin quarried material surface units;

c. two single second length thin quarried material surface units that each have a length edge that abuts an outer length edge of one of said first direction aligned first length thin quarried material surface units and a width edge of said substantially square orthogonal second direction aligned double first length thin quarried material surface unit pair;

d. a rectangular double second length thin quarried material surface unit pair that has a length edge that abuts a width edge of each of said two single second length thin quarried material surface units and a length edge of said substantially square orthogonal second direction aligned double first length thin quarried material surface unit pair;

e. two single third length thin quarried material surface units that each have a length edge that abuts an outer length edge of one of said single second length thin quarried material surface units and a width edge of said rectangular double second length thin quarried material surface unit pair;

f. a rectangular double third length thin quarried material surface unit pair that has a length edge that abuts a width edge of each of said two single third length thin quarried material surface units and a length edge of said rectangular double second length thin quarried material surface unit pair;

g. two single fourth length thin quarried material surface units that each have a length edge that abuts an outer length edge of one of said single third length thin quarried material surface units and a width edge of said rectangular double third length thin quarried material surface unit pair; and h. a rectangular double fourth length thin quarried material surface unit pair that has a length edge that abuts a width edge of each of said two single fourth length thin quarried material surface units and a length edge of said rectangular double third length thin quarried material surface unit pair.

10. A relational stone, building surface system as described in claim 9 wherein said repeatable installed thin quarried material surface unit pattern is inversely repeated in a first direction.

11. A quarried material surface constructed according to the pattern set forth in claim 10.

12. A relational stone, building surface system as described in claim 1 wherein said plurality of discrete predimensioned rectangular thin quarried material surface units are relatively arranged in at least one repeatable installed thin quarried material surface unit pattern that comprises: a first thin quarried material surface unit column, a second thin quarried material surface unit column, a third thin quarried material surface unit column, a fourth thin quarried material surface unit column, a fifth thin quarried material surface unit column, a sixth thin quarried material surface unit column, a seventh thin quarried material surface unit column, an eighth thin quarried material surface unit column and a ninth thin quarried material surface unit column, wherein said first thin quarried material surface unit column comprises a lower third length thin quarried material surface unit whose upper width edge abuts a lower width edge of a fourth length thin quarried material surface unit, wherein said second thin quarried material surface unit column comprises a lower third length thin quarried material surface unit whose upper width edge abuts a lower width edge of a third length thin quarried material surface unit whose upper width edge abuts a lower width edge of a first length thin quarried material surface unit, wherein said third thin quarried material surface unit column comprises a lower second length thin quarried material surface unit whose upper width edge abuts a lower width edge of a third length thin quarried material surface unit whose upper width edge abuts a lower width edge of a second length thin quarried material surface unit, wherein said fourth thin quarried material surface unit column comprises a lower fourth length thin quarried material surface unit whose upper width edge abuts a lower width edge of a third length thin quarried material surface unit, wherein said fifth thin quarried material surface unit column comprises a lower third length thin quarried material surface unit whose upper width edge abuts a lower width edge of a fourth length thin quarried material surface unit, wherein said sixth thin quarried material surface unit column comprises a lower fourth length thin quarried material surface unit whose upper width edge abuts a lower width edge of a third length thin quarried material surface unit, wherein said seventh thin quarried material surface unit column comprises a lower second length thin quarried material surface unit whose upper width edge abuts a lower width edge of a third length thin quarried material surface unit whose upper width edge abuts a lower width edge of a second length thin quarried material surface unit, wherein said eighth thin quarried material surface unit column comprises a lower third length thin quarried material surface unit whose upper width edge abuts a lower width edge of a third length thin quarried material surface unit whose upper width edge abuts a lower width edge of a first length thin quarried material surface unit, wherein said ninth thin quarried material surface unit column comprises a lower third length thin quarried material surface unit whose upper width edge abuts a lower width edge of a fourth length thin quarried material surface unit, wherein a right length edge of said first thin quarried material surface unit column abuts a left length edge of said second thin quarried material surface unit column, a right length edge of said second thin quarried material surface unit column abuts a left length edge of said third thin quarried material surface unit column, a right length edge of said third thin quarried material surface unit column abuts a left length edge of said fourth thin quarried material surface unit column, a right length edge of said fourth thin quarried material surface unit column abuts a left length edge of said fifth thin quarried material surface unit column, a right length edge of said fifth thin quarried material surface unit column abuts a left length edge of said sixth thin quarried material surface unit column, a right length edge of said sixth thin quarried material surface unit column abuts a left length edge of said seventh thin quarried material surface unit column, a right length edge of said seventh thin quarried material surface unit column abuts a left length edge of said eighth thin quarried material surface unit column, and a right length edge of said eighth thin quarried material surface unit column abuts a left length edge of said ninth thin quarried material surface unit column, wherein a lower width edge of said third length thin quarried material surface unit of said first thin quarried material surface unit column is substantially one and one-half times a first length thin quarried material surface unit length higher than a lower width edge of said lower third length thin quarried material surface unit of said second thin quarried material surface unit column, wherein a lower width edge of said lower third length thin quarried material surface unit of said second thin quarried material surface unit column is substantially one-half times a first length thin quarried material surface unit length lower than a lower width edge of said lower second length thin quarried material surface unit of said third thin quarried material surface unit column, wherein a lower width edge of said lower second length thin quarried material surface unit of said third thin quarried material surface unit column is substantially one-half times a first length thin quarried material surface unit length lower than a lower width edge of said fourth length thin quarried material surface unit of said fourth thin quarried material surface unit column, wherein a lower width edge of said fourth length thin quarried material surface unit of said fourth thin quarried material surface unit column is substantially one-half times a first length thin quarried material surface unit length lower than a lower width edge of said third length thin quarried material surface unit of said fifth thin quarried material surface unit column, wherein a lower width edge of said third length thin quarried material surface unit of said fifth thin quarried material surface unit column is substantially one-half times a first length thin quarried material surface unit length higher than a lower width edge of said fourth length thin quarried material surface unit of said sixth thin quarried material surface unit column, wherein a lower width edge of said fourth length thin quarried material surface unit of said sixth thin quarried material surface unit column is substantially one-half times a first length thin quarried material surface unit length higher than a lower width edge of said lower second length thin quarried material surface unit of said seventh thin quarried material surface unit column, wherein a lower width edge of said lower second length thin quarried material surface unit of said seventh thin quarried material surface unit column is substantially one-half times a first length thin quarried material surface unit length higher than a lower width edge of said lower third length thin quarried material surface unit of said eighth thin quarried material surface unit column, wherein a lower width edge of said lower third length thin quarried material surface unit of said eighth thin quarried material surface unit column is substantially one and one-half times a first length thin quarried material surface unit length lower than a lower width edge of said third length thin quarried material surface unit of said ninth thin quarried material surface unit column, and wherein said first thin quarried material surface unit column, said second thin quarried material surface unit column, said third thin quarried material surface unit column and said fourth thin quarried material surface unit column are repeatable in each a left, upward and downward direction, said sixth thin quarried material surface unit column, said seventh thin quarried material surface unit column, said eighth thin quarried material surface unit column and said ninth thin quarried material surface unit column are repeatable in each a right, upward and downward direction, and said fifth thin quarried material surface unit column is repeatable in a upward and downward direction.

13. A relational stone, building surface system as described in claim 12 wherein said first thin quarried material surface unit column further comprises:

a. an additional first column fourth length thin quarried material surface unit whose upper width edge abuts a lower width edge of said lower third length thin quarried material surface unit of said first thin quarried material surface unit column; and b. an additional first column third length thin quarried material surface unit whose upper width edge abuts a lower width edge of said additional first column fourth length thin quarried material surface unit, wherein said second thin quarried material surface unit column further comprises:

a. a lower additional second column third length thin quarried material surface unit;

b. an upper additional second column third length thin quarried material surface unit having a lower width edge that abuts an upper width edge of said lower additional second column third length thin quarried material surface unit; and c. an additional second column first length thin quarried material surface unit having a lower width edge that abuts an upper width edge of said upper additional second column third length thin quarried material surface unit and having an upper width edge that abuts a lower width edge of said lower third length thin quarried material surface unit of said second column, wherein said third thin quarried material surface unit column further comprises:

a. a additional third column third length thin quarried material surface unit;

b. a lower additional third column second length thin quarried material surface unit having a lower width edge that abuts an upper width edge of said lower additional third column third length thin quarried material surface unit; and c. an upper additional third column second length thin quarried material surface unit having a lower width edge that abuts an upper width edge of said lower additional third column second length thin quarried material surface unit and having an upper width edge that abuts a lower width edge of said lower second length thin quarried material surface unit of said third column, wherein said fourth thin quarried material surface unit column further comprises:

a. an additional fourth column third length thin quarried material surface unit whose upper width edge abuts a lower width edge of said lower fourth length thin quarried material surface unit of said fourth thin quarried material surface unit column;

b. an additional fourth column fourth length thin quarried material surface unit whose upper width edge abuts a lower width edge of said additional fourth column third length thin quarried material surface unit, wherein said fifth thin quarried material surface unit column further comprises:

a. an additional fifth column fourth length thin quarried material surface unit whose upper width edge abuts a lower width edge of said lower third length thin quarried material surface unit of said fifth thin quarried material surface unit column; and b. an additional fifth column third length thin quarried material surface unit whose upper width edge abuts a lower width edge of said additional fifth column fourth length thin quarried material surface unit, wherein said sixth thin quarried material surface unit column further comprises:

a. an additional sixth column third length thin quarried material surface unit whose upper width edge abuts a lower width edge of said lower fourth length thin quarried material surface unit of said sixth thin quarried material surface unit column; and b. an additional sixth column fourth length thin quarried material surface unit whose upper width edge abuts a lower width edge of said additional sixth column third length thin quarried material surface unit, wherein said seventh thin quarried material surface unit column further comprises:

a. an additional seventh column third length thin quarried material surface unit;

b. a lower additional seventh column second length thin quarried material surface unit having a lower width edge that abuts an upper width edge of said lower additional seventh column third length thin quarried material surface unit; and c. an upper additional seventh column second length thin quarried material surface unit having a lower width edge that abuts an upper width edge of said lower additional seventh column second length thin quarried material surface unit and having an upper width edge that abuts a lower width edge of said lower second length thin quarried material surface unit of said seventh column, wherein said eighth thin quarried material surface unit column further comprises:

a. a lower additional eighth column third length thin quarried material surface unit;

b. an upper additional eighth column third length thin quarried material surface unit having a lower width edge that abuts an upper width edge of said lower additional eighth column third length thin quarried material surface unit; and c. an additional eighth column first length thin quarried material surface unit having a lower width edge that abuts an upper width edge of said upper additional eighth column third length thin quarried material surface unit and having an upper width edge that abuts a lower width edge of said lower third length thin quarried material surface unit of said eighth column, and wherein said ninth thin quarried material surface unit column further comprises:

a. an additional ninth column fourth length thin quarried material surface unit whose upper width edge abuts a lower width edge of said lower third length thin quarried material surface unit of said ninth thin quarried material surface unit column; and b. an additional ninth column third length thin quarried material surface unit whose upper width edge abuts a lower width edge of said additional ninth column fourth length thin quarried material surface unit.

14. An installed quarried material surface constructed according to the pattern set forth in claim 12 or 13.

15. A relational stone, building surface system as described in claim 1 wherein said plurality of discrete predimensioned rectangular thin quarried material surface units are relatively arranged in a central installed thin quarried material surface unit core set and four directionally repeating installed thin quarried material surface unit sets, wherein said central installed thin quarried material surface unit core set comprises:

a. at least one center leader surface square, and b. a first border surface section comprising:

i. a left first double diagonal cut thin quarried material surface unit that has an inner length of substantially a first length thin quarried material surface unit length and that has an inner length edge that abuts a left edge of said center leader surface square;

ii. a upward first double diagonal cut thin quarried material surface unit that has an inner length of substantially a first length thin quarried material surface unit length and that has an inner length edge that abuts an upward edge of said center leader surface square;

iii. a downwards first double diagonal cut thin quarried material surface unit that has an inner length of substantially a first length thin quarried material surface unit length and that has an inner length edge that abuts a downwards edge of said center leader surface square; and iv. a right first double diagonal cut thin quarried material surface unit that has an inner length of substantially a first length thin quarried material surface unit length and that has an inner length edge that abuts a upward edge of said center leader surface square;

c. a second border surface section comprising:

i. a left second double diagonal cut thin quarried material surface unit that has an inner length of substantially a second length thin quarried material surface unit length and that has a inner length edge that abuts an outer length edge of said left first double diagonal cut thin quarried material surface unit;

ii. a upward second double diagonal cut thin quarried material surface unit that has an inner length of substantially a second length thin quarried material surface unit length and that has a inner length edge that abuts an outer length edge of said upward first double diagonal cut thin quarried material surface unit;

iii. a downward second double diagonal cut thin quarried material surface unit that has an inner length of substantially a second length thin quarried material surface unit length and that has a inner length edge that abuts an outer length edge of said downward first double diagonal cut thin quarried material surface unit; and iv. a right second double diagonal cut thin quarried material surface unit that has an inner length of substantially a second length thin quarried material surface unit length and that has a inner length edge that abuts an outer length edge of said right first double diagonal cut thin quarried material surface unit;

d. a third border surface section comprising:

i. a left third double diagonal cut thin quarried material surface unit that has an inner length of substantially a third length thin quarried material surface unit length and that has a inner length edge that abuts an outer length edge of said left second double diagonal cut thin quarried material surface unit;

ii. a upward third double diagonal cut thin quarried material surface unit that has an inner length of substantially a third length thin quarried material surface unit length and that has a inner length edge that abuts an outer length edge of said upward second double diagonal cut thin quarried material surface unit;

iii. a downward third double diagonal cut thin quarried material surface unit that has an inner length of substantially a third length thin quarried material surface unit length and that has a inner length edge that abuts an outer length edge of said downward second double diagonal cut thin quarried material surface unit; and iv. a right third double diagonal cut thin quarried material surface unit that has an inner length of substantially a third length thin quarried material surface unit length and that has a inner length edge that abuts an outer length edge of said right second double diagonal cut thin quarried material surface unit, wherein said four directionally repeating installed thin quarried material surface unit sets comprise:

a. a fourth border surface section comprising:

i. a left fourth border surface section comprising two left fourth border single diagonal cut thin quarried material surface units each having an outer length of substantially a second length thin quarried material surface unit length; and a left, fourth border first length thin quarried material surface unit disposed between said two fourth border single diagonal cut thin quarried material surface units so that each width edge of said left fourth border first length thin quarried material surface unit abuts a width edge of one of said left fourth border single diagonal cut thin quarried material surface units;

ii. a upward fourth border surface section comprising two upward fourth border single diagonal cut thin quarried material surface units each having an outer length of substantially a second length thin quarried material surface unit length; and an upward fourth border first length thin quarried material surface unit disposed between said two fourth border single diagonal cut thin quarried material surface units so that each width edge of said upward fourth border first length thin quarried material surface unit abuts a width edge of one of said upward fourth border single diagonal cut thin quarried material surface units;

iii. a right fourth border surface section comprising two right fourth border single diagonal cut thin quarried material surface units each having an outer length of substantially a second length thin quarried material surface unit length; and a right, fourth border, first length thin quarried material surface unit disposed between said two single diagonal cut thin quarried material surface units so that each width edge of said right fourth border first length thin quarried material surface unit abuts a width edge of one of said right fourth border single diagonal cut thin quarried material surface units; and iv. a downwards fourth border surface section comprising two downwards fourth border single diagonal cut thin quarried material surface units each having an outer length of substantially a second length thin quarried material surface unit length; and a downwards, fourth border first length thin quarried material surface unit disposed between said two single diagonal cut thin quarried material surface units so that each width edge of said downward fourth border first length thin quarried material surface unit abuts a width edge of one of said downwards fourth border single diagonal cut thin quarried material surface units;

b. a fifth border surface section comprising:

i. a left fifth border surface section comprising two left fifth border single diagonal cut thin quarried material surface units each having an outer length of substantially a second length thin quarried material surface unit length; and a left fifth border second length thin quarried material surface unit disposed between said two single diagonal cut thin quarried material surface units so that each width edge of said left fifth border second length thin quarried material surface unit abuts a width edge of one of said left fifth border single diagonal cut thin quarried material surface units;

ii. a upward fifth border surface section comprising two upward fifth border single diagonal cut thin quarried material surface units each having an outer length of substantially a second length thin quarried material surface unit length; and an upward fifth border second length thin quarried material surface unit disposed between said two single diagonal cut thin quarried material surface units so that each width edge of said upward fifth border second length thin quarried material surface unit abuts a width edge of one of said upward fifth border single diagonal cut thin quarried material surface units;

iii. a downwards fifth border surface section comprising two downwards fifth border single diagonal cut thin quarried material surface units each having an outer length of substantially a second length thin quarried material surface unit length; and a downward fifth border second length thin quarried material surface unit disposed between said two single diagonal cut thin quarried material surface units so that each width edge of said downward fifth border second length thin quarried material surface unit abuts a width edge of one of said downwards fifth border single diagonal cut thin quarried material surface units; and iv. a right fifth border surface section comprising two right fifth border single diagonal cut thin quarried material surface units each having an outer length of substantially a second length thin quarried material surface unit length; and a right fifth border second length thin quarried material surface unit disposed between said two single diagonal cut thin quarried material surface units so that each width edge of said right fifth border second length thin quarried material surface unit abuts a width edge of one of said right fifth border single diagonal cut thin quarried material surface units;

c. a sixth border surface section comprising:

i. a left sixth border surface section comprising two left sixth border single diagonal cut thin quarried material surface units each having an outer length of substantially a second length thin quarried material surface unit length; and a left sixth border third length thin quarried material surface unit disposed between said two single diagonal cut thin quarried material surface units so that each width edge of said left sixth border third length thin quarried material surface unit abuts a width edge of one of said left sixth border single diagonal cut thin quarried material surface units;

ii. a upward sixth border surface section comprising two upward sixth border single diagonal cut thin quarried material surface units each having an outer length of substantially a second length thin quarried material surface unit length; and an upward sixth border third length thin quarried material surface unit disposed between said two single diagonal cut thin quarried material surface units so that each width edge of said upward sixth border third length thin quarried material surface unit abuts a width edge of one of said upward sixth border single diagonal cut thin quarried material surface units;

iii. a downward sixth border surface section comprising two downwards sixth border single diagonal cut thin quarried material surface units each having an outer length of substantially a second length thin quarried material surface unit length; and a downward sixth border third length thin quarried material surface unit disposed between said two single diagonal cut thin quarried material surface units so that each width edge of said downward sixth border third length thin quarried material surface unit abuts a width edge of one of said downward sixth border single diagonal cut thin quarried material surface units; and iv. a right sixth border surface section comprising two right sixth border single diagonal cut thin quarried material surface units each having an outer length of substantially a second length thin quarried material surface unit length; and a right sixth border third length thin quarried material surface unit disposed between said two single diagonal cut thin quarried material surface units so that each width edge of said right sixth border fourth length thin quarried material surface unit abuts a width edge of one of said right sixth border single diagonal cut thin quarried material surface units;

d. a seventh border surface section comprising:

i. a left seventh border surface section comprising:

ii. two left seventh border single diagonal cut thin quarried material surface units each having an outer length of substantially a second length thin quarried material surface unit length; and a left seventh border fourth length thin quarried material surface unit disposed between said two single diagonal cut thin quarried material surface units so that each width edge of said left seventh border fourth length thin quarried material surface unit abuts a width edge of one of said left seventh border single diagonal cut thin quarried material surface units;

iii. an upward seventh border surface section comprising two upward seventh border single diagonal cut thin quarried material surface units each having an outer length of substantially a second length thin quarried material surface unit length; and an upward seventh border fourth length thin quarried material surface unit disposed between said two single diagonal cut thin quarried material surface units so that each width edge of said upward seventh border fourth length thin quarried material surface unit abuts a width edge of one of said upward seventh border single diagonal cut thin quarried material surface units;

iv. a downward seventh border surface section comprising two downward seventh border single diagonal cut thin quarried material surface units each having an outer length of substantially a second length thin quarried material surface unit length; and a downward seventh border fourth length thin quarried material surface unit disposed between said two single diagonal cut thin quarried material surface units so that each width edge of said downward seventh border fourth length thin quarried material surface unit abuts a width edge of one of said downward seventh border single diagonal cut thin quarried material surface units; and v. a right seventh border surface section comprising two right seventh border single diagonal cut thin quarried material surface units each having an outer length of substantially a second length thin quarried material surface unit length; and a right seventh border fourth length thin quarried material surface unit disposed between said two single diagonal cut thin quarried material surface units so that each width edge of said right seventh border fourth length thin quarried material surface unit abuts a width edge of one of said right seventh border single diagonal cut thin quarried material surface units, wherein an inner edge of said first border surface section abuts an outer edge of said at least one center leader surface square; an inner edge of said second border surface section abuts an outer edge of said first border surface section; an inner edge of said third border surface section abuts an outer edge of said second border surface section; an inner edge of said fourth border surface section abuts an outer edge of said third border surface section; an inner edge of said fifth border surface section abuts an outer edge of said fourth border surface section; an inner edge of said sixth border surface section abuts an outer edge of said fifth border surface section; and an inner edge of said seventh border surface section abuts an outer edge of said sixth border surface section, wherein said left fourth border surface section, said left fifth border surface section, said left sixth border surface section, and said left seventh border surface section are each repeatable in a left direction, wherein upward fourth border surface section, said upward fifth border surface section, said upward sixth border surface section, and said upward seventh border surface section are each repeatable in an upward direction, wherein said right fourth border surface section, said right fifth border surface section, said right sixth border surface section, and said right seventh border surface section are each repeatable in a right direction, and wherein said downward fourth border surface section, said downward fifth border surface section, said downward sixth border surface section, and said downward seventh border surface section are each repeatable in a downward direction.

16. A relational stone, building surface system as described in claim 15 said at least one center leader surface square comprises two first length thin quarried material surface units that each abut one another along a length edge.

17. An installed quarried material surface constructed according to the pattern set forth in claim 15 or 16.

18. A relational stone, building surface system as described in claim 1 wherein said plurality of discrete predimensioned rectangular thin quarried material surface units are relatively arranged in at least one repeatable installed thin quarried material surface unit pattern comprising:

a. a first thin quarried material surface unit layer comprising a first layer fourth length thin quarried material surface unit having a right width edge that abuts a left width edge of a first layer first length thin quarried material surface unit;

b. a second thin quarried material surface unit layer comprising a second layer third length thin quarried material surface unit having a right width edge that abuts a left width edge of a second layer second length thin quarried material surface unit, wherein a lower length edge of said second thin quarried material surface unit layer abuts an upper length edge of said first thin quarried material surface unit layer; and c. a third thin quarried material surface unit layer comprising a third layer second length thin quarried material surface unit having a right width edge that abuts a left width edge of a third layer third length thin quarried material surface unit, wherein a lower length edge of said third thin quarried material surface unit layer abuts an upper length edge of said second thin quarried material surface unit layer, wherein a right width edge of said first layer first length thin quarried material surface unit is substantially one-half a first length thin quarried material surface unit length left of a right width edge of said second layer second length thin quarried material surface unit, and wherein a right width edge of said second layer second length thin quarried material surface unit is substantially one-half a first length thin quarried material surface unit length left of a right width edge of said third layer third length thin quarried material surface unit.

19. A relational stone, building surface system as described in claim 18 further comprising a fourth thin quarried material surface unit layer that comprises a fourth layer first length thin quarried material surface unit having a right width edge that abuts a left width edge of a fourth layer fourth length thin quarried material surface unit, wherein a lower length edge of said fourth thin quarried material surface unit layer abuts an upper length edge of said third thin quarried material surface unit layer, and wherein a right width edge of said third layer third length thin quarried material surface unit is substantially one-half a first length thin quarried material surface unit length left of a right width edge of said fourth layer fourth length thin quarried material surface unit.

20. An installed quarried material surface constructed according to the pattern set forth in claim 18 or 19.

* * * * *